US006856083B2

(12) United States Patent
Okuda

(10) Patent No.: US 6,856,083 B2
(45) Date of Patent: Feb. 15, 2005

(54) DISPLAY PANEL DRIVING DEVICE

(75) Inventor: Yoshiyuki Okuda, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/679,503

(22) Filed: Oct. 7, 2003

(65) Prior Publication Data

US 2004/0119416 A1 Jun. 24, 2004

(30) Foreign Application Priority Data

Oct. 8, 2002 (JP) ..... 2002-294839
Oct. 8, 2002 (JP) ..... 2002-294840

(51) Int. Cl.[7] ..... H01J 1/62
(52) U.S. Cl. ..... 313/484; 313/585
(58) Field of Search ..... 315/169.1, 169.4; 313/484, 485, 582, 584, 585; 345/60, 66, 67, 74, 75

(56) References Cited

U.S. PATENT DOCUMENTS 5,800,232 A * 9/1998 Miyazaki ..... 313/585
6,028,574 A * 2/2000 Bancal ..... 345/75.1
6,614,411 B2 * 9/2003 Hayashi ..... 313/484

* cited by examiner

*Primary Examiner*—Wilson Lee
(74) *Attorney, Agent, or Firm*—Morgan, Lewis & Bockius LLP

(57) ABSTRACT

A display panel driving device has a simple substrate structure. Amorphous silicon material or organic semiconductor material can be used for the substrate structure. A data code wiring group which is the base of row addresses of the display panel, and an address electrode line wiring group, intersect each other. The two wiring groups sandwich a compound layer of an insulating film and a semiconductor film. By providing disconnected portions at prescribed intersecting points on the address electrode lines, MOS type transistors are formed at the disconnected portions. A logic circuit is configured for row address decoding, in which MOS type transistors are connected in series to a single address electrode line.

26 Claims, 38 Drawing Sheets

FIG. 5

| ADDRESS AL | RELATION BETWEEN CODE GROUP SUPERPOSED ON DATA CONTROL LINE GROUP (Y2 TO Y0 AND Y2b TO Y0b) AND DECODED ADDRESS | | | | | |
|---|---|---|---|---|---|---|
| | BINARY CODE | | | INVERTED BINARY CODE | | |
| | Y2 | Y1 | Y0 | Y2b | Y1b | Y0b |
| AL=1 | 0 | 0 | 0 | 1 | 1 | 1 |
| AL=2 | 0 | 0 | 1 | 1 | 1 | 0 |
| AL=3 | 0 | 1 | 0 | 1 | 0 | 1 |
| AL=4 | 0 | 1 | 1 | 1 | 0 | 0 |
| AL=5 | 1 | 0 | 0 | 0 | 1 | 1 |
| AL=6 | 1 | 0 | 1 | 0 | 1 | 0 |
| AL=7 | 1 | 1 | 0 | 0 | 0 | 1 |
| AL=8 | 1 | 1 | 1 | 0 | 0 | 0 |

FIG. 17

| ADDRESS AL | RELATION BETWEEN CODE GROUP SUPERPOSED ON DATA CONTROL LINE GROUP (Y2 TO Y0 AND Y2b TO Y0b) AND DECODED ADDRESS | | | | | |
|---|---|---|---|---|---|---|
| | BINARY CODE | | | INVERTED BINARY CODE | | |
| | Y2 | Y1 | Y0 | Y2b | Y1b | Y0b |
| AL=1 | 0 | 0 | 0 | 1 | 1 | 1 |
| AL=2 | 0 | 0 | 1 | 1 | 1 | 0 |
| AL=3 | 0 | 1 | 0 | 1 | 0 | 1 |
| AL=4 | 0 | 1 | 1 | 1 | 0 | 0 |
| AL=5 | 1 | 0 | 0 | 0 | 1 | 1 |
| AL=6 | 1 | 0 | 1 | 0 | 1 | 0 |
| AL=7 | 1 | 1 | 0 | 0 | 0 | 1 |
| AL=8 | 1 | 1 | 1 | 0 | 0 | 0 |

FIG. 31

| DATA ELECTRODE ADDRESS (DL) | RELATION BETWEEN CODE GROUP SUPERPOSED ON ADDRESS LINE GROUP (X2 TO X0 AND X2b TO X0b) AND DECODED ADDRESS | | | | | |
|---|---|---|---|---|---|---|
| | BINARY CODE | | | INVERTED BINARY CODE | | |
| | X2 | X1 | X0 | X2b | X1b | X0b |
| DL=1 | 0 | 0 | 0 | 1 | 1 | 1 |
| DL=2 | 0 | 0 | 1 | 1 | 1 | 0 |
| DL=3 | 0 | 1 | 0 | 1 | 0 | 1 |
| DL=4 | 0 | 1 | 1 | 1 | 0 | 0 |
| DL=5 | 1 | 0 | 0 | 0 | 1 | 1 |
| DL=6 | 1 | 0 | 1 | 0 | 1 | 0 |
| DL=7 | 1 | 1 | 0 | 0 | 0 | 1 |
| DL=8 | 1 | 1 | 1 | 0 | 0 | 0 |

DISPLAY PANEL DRIVING DEVICE

BACKGROUND OF THE INVENTION

1. Field of the Invention

The present invention generally relates to a display panel driving device.

2. Description of the Related Art

One type of display panels is an active matrix type display panel that includes a plurality of address electrodes and a plurality of data electrodes. The address electrodes and data electrodes intersect with each other perpendicularly such that a plurality of display elements are sandwiched (defined) between the address electrodes and data electrodes. Organic electroluminescence (hereafter simply referred to as "organic EL") light-emitting elements are used as the display elements. Such display panel is disclosed in, for example, Japanese Patent Application No. 2002-93856. The entire disclosure of Japanese Patent Application No. 2002-93856 is incorporated herein by reference. The structure of this display panel is schematically shown in FIG. 1 of the attached drawings.

In FIG. 1, a display panel 10 includes a plurality of display elements arranged in a matrix form. The display elements include TFT elements and organic EL light-emitting elements. According to the VGA (Video Graphics Adapter) standard which is an international standard for display panels, the display elements of the display panel 10 are arranged in, for example, 640 (x RGB) columns by 480 rows of dots.

The X transfer circuit 20 which is a peripheral circuit of the display panel 10 supplies image data signals (referred to as "data signals") to each of the display element groups arranged in the 640 (x RGB) columns. That is, 640 parallel data electrodes extend from the X transfer circuit 20, for each of the RGB display elements, in the X-axis direction of the display panel 10.

The Y transfer circuit 30 selects, with prescribed timing, one of the display element groups in the 480 rows, and supplies an address signal, which is a selection signal, to the selected row of display elements (selected display element group). The 480 parallel address electrodes extend from the Y transfer circuit 30 in the Y-axis direction of the display panel 10.

Hereafter, in this specification the X transfer circuit 20 and Y transfer circuit 30 which are peripheral circuits of the display panel 10 are jointly referred to as the driving device of the display panel 10.

Conventionally, the driving device mainly includes shift registers and other active circuits. For example, the X transfer circuit 20 uses a 640-stage shift register to sequentially shift X transfer pulses contained in the X transfer signal shown in FIG. 1, and relies upon the shifted pulses to sample-hold analog signals for the RGB display elements so as to generate the above-mentioned data signals. The Y transfer circuit 30 uses a 480-stage shift register to sequentially shift the Y transfer pulses contained in the Y transfer signal shown in FIG. 1, to generate the above-mentioned address signals.

In order to configure a sequential logic circuit such as a shift register and a sample-hold circuit, transistors with both polarities, P-channel and N-channel, are required. Consequently, amorphous silicon and organic semiconductors, from which only unipolar transistors and diodes can be fabricated, cannot be used as the semiconductor material for the driving device of the display panel 10. Therefore, low-temperature polysilicon semiconductor material, which is costly and involves complicated production processes, is primarily used.

SUMMARY OP THE INVENTION

The above-described problems are examples of the problems to be solved by the present invention.

According to one aspect of the present invention, there is provided an improved driving device for a display panel. The display panel includes a plurality of address electrodes, a plurality of data electrodes, a plurality of display elements and a first substrate such that the address electrodes and data electrodes intersect each other on the first substrate. The display elements are defined between the address electrodes and data electrodes. The driving device includes a second substrate, a plurality of control lines for address signal generation, an insulating film, a channel material film in contact with the insulating film, and a plurality of extension lines. The control lines extend in parallel to each other. The extension lines extend to the address electrodes, respectively. It should be noted that it can be said the extension lines extend from the address electrodes because the extension lines are called "address electrode extension lines." At least the insulating film is enclosed between the extension lines and the control lines on the second substrate. The extension lines intersect with the control lines to form a plurality of intersecting portions. Each extension line has at least one disconnected portion at the intersecting portions.

According to a second aspect of the present invention, there is provided another improved driving device for a display panel. The display panel includes a plurality of address electrodes, a plurality of data electrodes, a plurality of display elements and a first substrate. The address electrodes and data electrodes intersect each other on the first substrate and enclose the display elements between the address electrodes and the data electrodes. The driving device includes a second substrate, a plurality of control lines for address signal generation, provided mutually in parallel, an insulating film, a diode functional film, and a plurality of extension lines extending to the address electrodes, respectively. The insulating film and the diode functional film generally extend between the extension lines and the control lines on the second substrate. The extension lines intersect with the control lines to form a plurality of intersecting portions. The insulating film has at least one aperture in at least one of the intersecting portions.

According to a third aspect of the present invention, there is provided another improved driving device for a display panel. The display panel includes a plurality of address electrodes, a plurality of data electrodes, a plurality of display elements and a first substrate. The address electrodes and data electrodes intersect each other on the first substrate and enclose the display elements between the address electrodes and the data electrodes. The driving device includes a second substrate, a plurality of control lines for data signal generation, and one or more analog signal input lines, extending in parallel with the plurality of control lines. The driving device also includes a plurality of control connection lines, intersecting the control lines and analog signal input line(s) to form a plurality of intersecting portions. The insulating film and diode functional film generally extend between the control connection lines and the control lines and analog signal input line(s) on the second substrate. A plurality of extension lines extend from the data electrodes, respectively. The extension lines have overlapping portions which overlap end portions of the control connection lines on the second substrate to sandwich the insulating film and the diode functional film. The insulating film has aperture portions in at least one of the intersecting portions and in the overlapping portions.

BRIEF DESCRIPTION OF THE DRAWINGS

FIG. 5 is a code table representing the relationship between code groups superposed on data control line groups and code addresses, used by the circuit of FIG. 4;

FIG. 17 is a code table representing the relationship between code groups superposed on data control line groups and code addresses, used by the circuit of FIG. 16;

FIG. 31 is a code table representing the relationship between code groups superposed on address line groups and code addresses, used by the circuit of FIG. 30;

DETAILED DESCRIPTION OF THE INVENTION

First Embodiment

Figure 1:
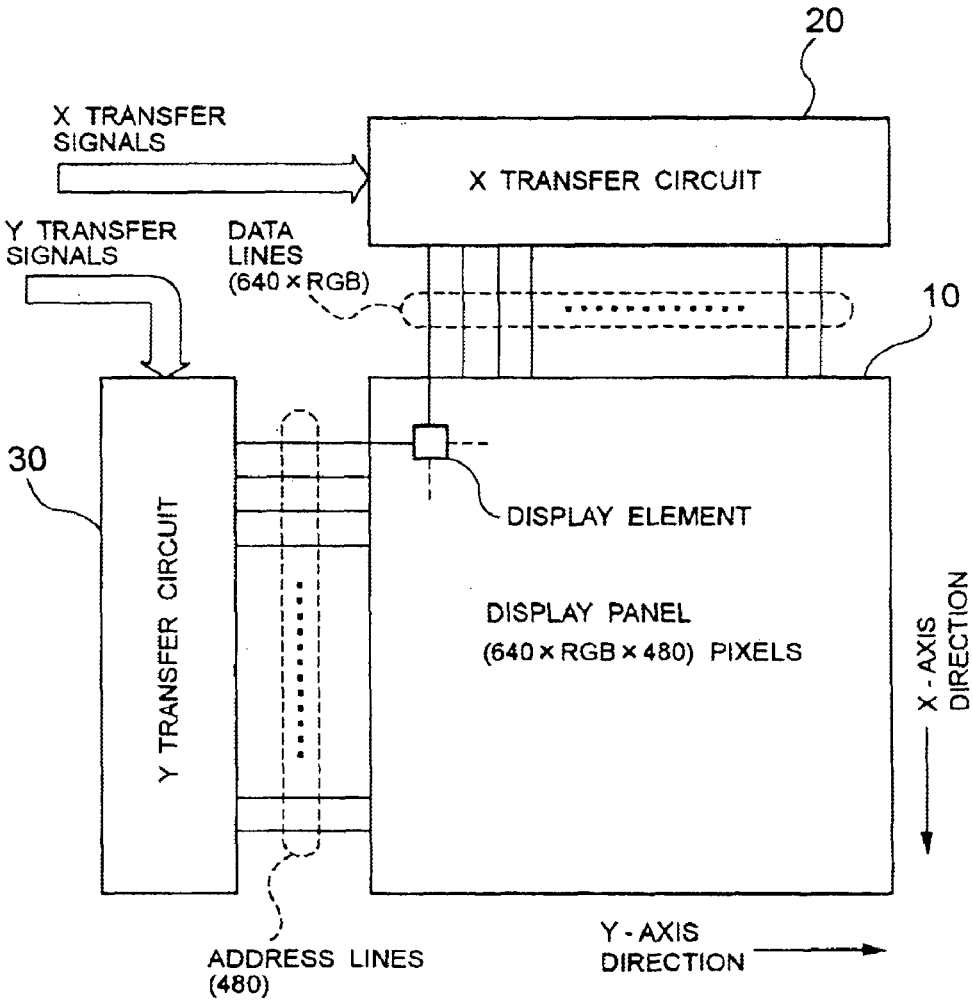
FIG. 1 is a block diagram showing the configuration of an active matrix display panel.
Figure 2:
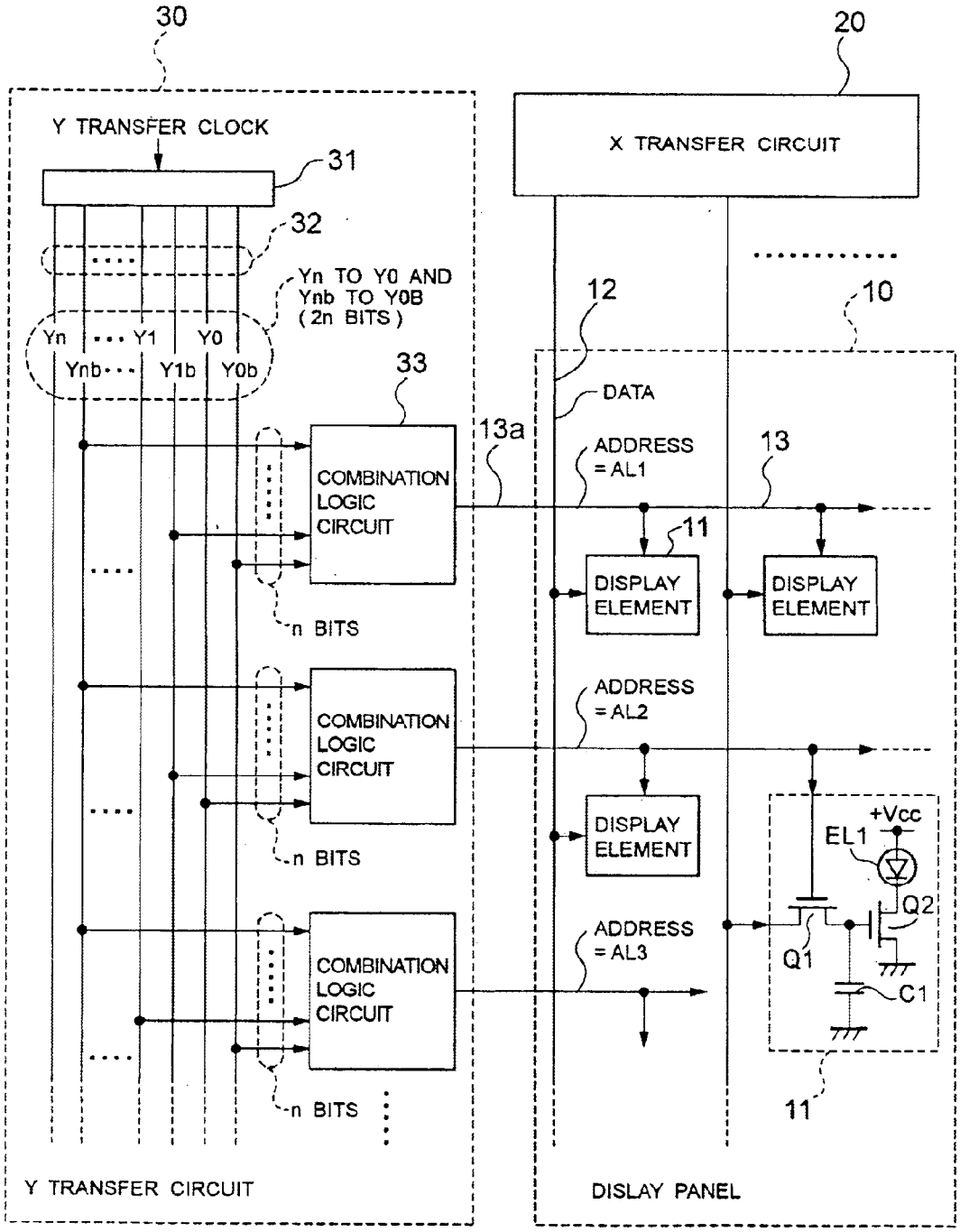
FIG. 2 is a block diagram of a display panel driving device of a first embodiment of the present invention.

Referring to FIG. 2, a first embodiment of a display panel driving device of the present invention will be described.

As shown in FIG. 2, each of display elements 11 arranged in a matrix form on the surface of the display panel 10 primarily includes a light-emitting element EL1, a data-writing transistor Q1, a light-emitting element driving transistor Q2, and a storage capacitor C1. Here, the light emission operation in the light-emitting elements 11 will be described first. The data-writing transistor Q1 is turned on by a Y transfer pulse (address signal) superposed on an address electrode 13 with prescribed timing. At this time, electric charge due to an X transfer pulse (data signal) superposed on the data electrode 12 is accumulated in the capacitor C1 via the transistor Q1. When the capacitor C1 has accumulated charge, this charge causes the gate potential of the driving transistor Q2 to be at a high potential, so that the driving transistor Q2 is turned on, and a driving current from the power supply at voltage +Vcc is supplied to the light-emitting element EL1, causing the light-emitting element EL1 to emit light.

Next, the display panel driving device will be described. An important aspect of the display panel driving device is the substrate structure of the Y transfer circuit 30. Hence, in this specification, only the configuration of the Y transfer circuit 30 will be described. Lines 13*a* extending from the Y transfer circuit 30 to the display panel 10 are referred to as extension lines of the address electrodes 13.

The Y transfer circuit 30 is an address signal generation circuit which generates address signals to select display element groups in each row of the display panel 10, in sync with the Y transfer clock (approximately 28.8 kHz) supplied from the control device (not shown) of the display panel 10. The generated address signals are as shown in the time chart of FIG. 3.

Figure 3:
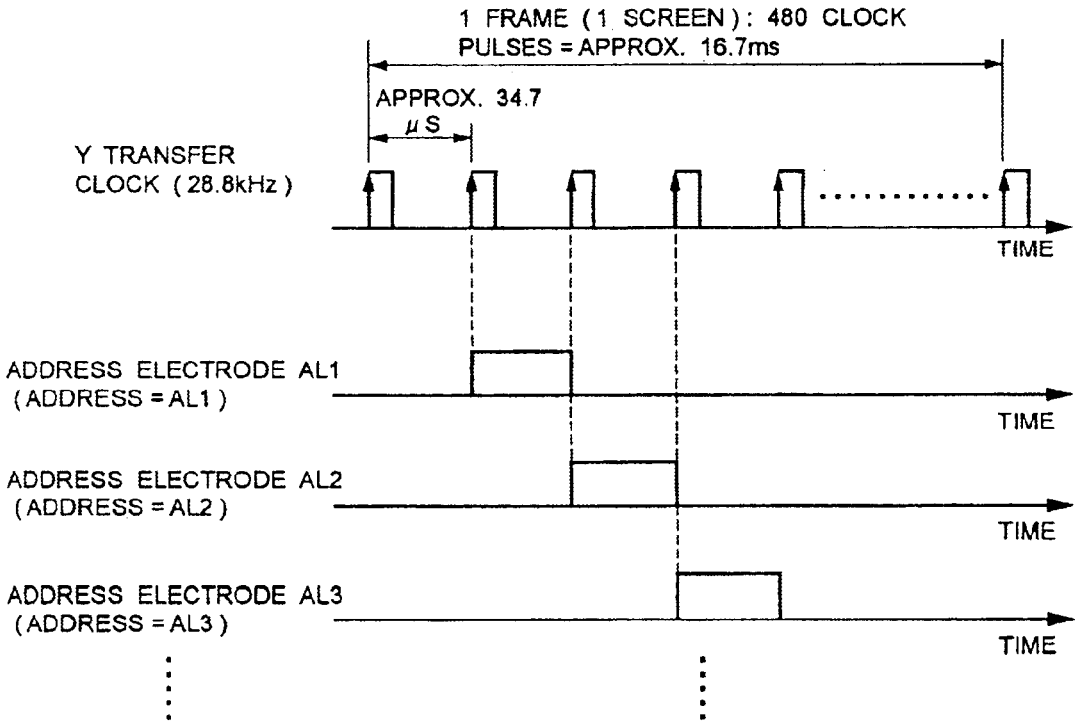
FIG. 3 is a time chart indicating the operation of the display panel driving device of FIG. 2.

As shown in FIG. 3, the Y transfer circuit 30, which is an address signal generation circuit (hereafter, for convenience of explanation, the Y transfer circuit 30 is called the address signal generation circuit), generates scan pulses to sequentially select 480 rows of display element groups positioned on the display panel 10, during an interval of approximately 16.7 ms (1/60 Hz) which is the time of one screen (one frame) displayed on the display panel. The address signal generation circuit 30 generates an address signal in sync with a Y transfer clock, uses the address signal as the scan pulse and supplies the scan pulse to each row of display element groups on the display panel 10.

Next, the internal configuration of the address signal generation circuit 30 is described. As shown in FIG. 2, the address signal generation circuit 30 includes a data control line group 32 (hereafter simply called "control line group 32") for address signal generation, an address signal generation data supply circuit 31 (hereafter simply called "supply circuit 31") to supply address signal generation data to the control line group 32, a plurality of combinatorial logic circuits 33, and a plurality of address electrodes 13. The address signal generation data is superposed on the control line group 32. The address signal generation data is a code group which serves as the basis for generating the address signals. That is, the supply circuit 31 counts Y transfer clock pulses using, for example, a 480-ary binary counter, and generates pulse signals for each of the $2^0$ to $2^n$ digits, as well as inverted pulse signals for each of these digits. These pulse signals are then arranged in 2n-bit codes, which are used as the above-mentioned code group.

In FIG. 2, 480 rows of display element groups are arranged in the Y-axis direction on the display panel 10. Hence, the number of bits of binary code required to generate row addresses for each of the first row to 480th row is nine because the following relation is established:

$$512>480>256$$

that is, $$2^9>480>2^8$$

In other words, a binary code of length 9 bits is sufficient.

Hence, the supply circuit 31 can be constructed from a 480-ary binary counter which counts Y transfer clock pulses, and an inverter circuit (neither shown in the figure). That is, in the embodiment of FIG. 2, n is equal to nine, and address signal generation data generated by the supply circuit 31 includes a 9-bit binary code and the inverted code of the same. A code with 18 bits (or 2n bits) is supplied to the control line group 32. In other words, the control line group 32 includes 18 control lines, on which are superposed 9-bit binary codes Y8 (MSB) to Y0 (LSB), and the inverted codes Y8*b* (MSB) to Y0*b* (LSB) of the same, respectively.

As described above, in order to count Y transfer clock pulses (approximately 28.8 kHz), one count step for the 480-ary binary counter is approximately 34.7 $\mu$s, which is one period of the Y transfer clock, as shown in FIG. 3. The time required for 480 counts or one complete revolution of the count value of the 480-ary binary counter is approximately 16.7 ms (approximately 34.7 $\mu$s×480 steps), which is the time equivalent to one frame of the display screen.

The combinatorial logic circuit 33 includes AND gates, OR gates, and other logic gate circuits, and is required on each row of the display panel 10. Hence, in the embodiment shown in FIG. 2, 480 combinatorial logic circuits are required, corresponding to the 480 address electrodes 13 from row 1 to row 480. 9-bit (n-bit; n=9) control lines, from the control line group 32, are connected to each of these combinatorial logic circuits 33. Each of the combinatorial logic circuits 33 uses the code consisting of these nine bits to output a selection signal for the associated address electrode of the display panel, that is, an address signal.

Figure 4:
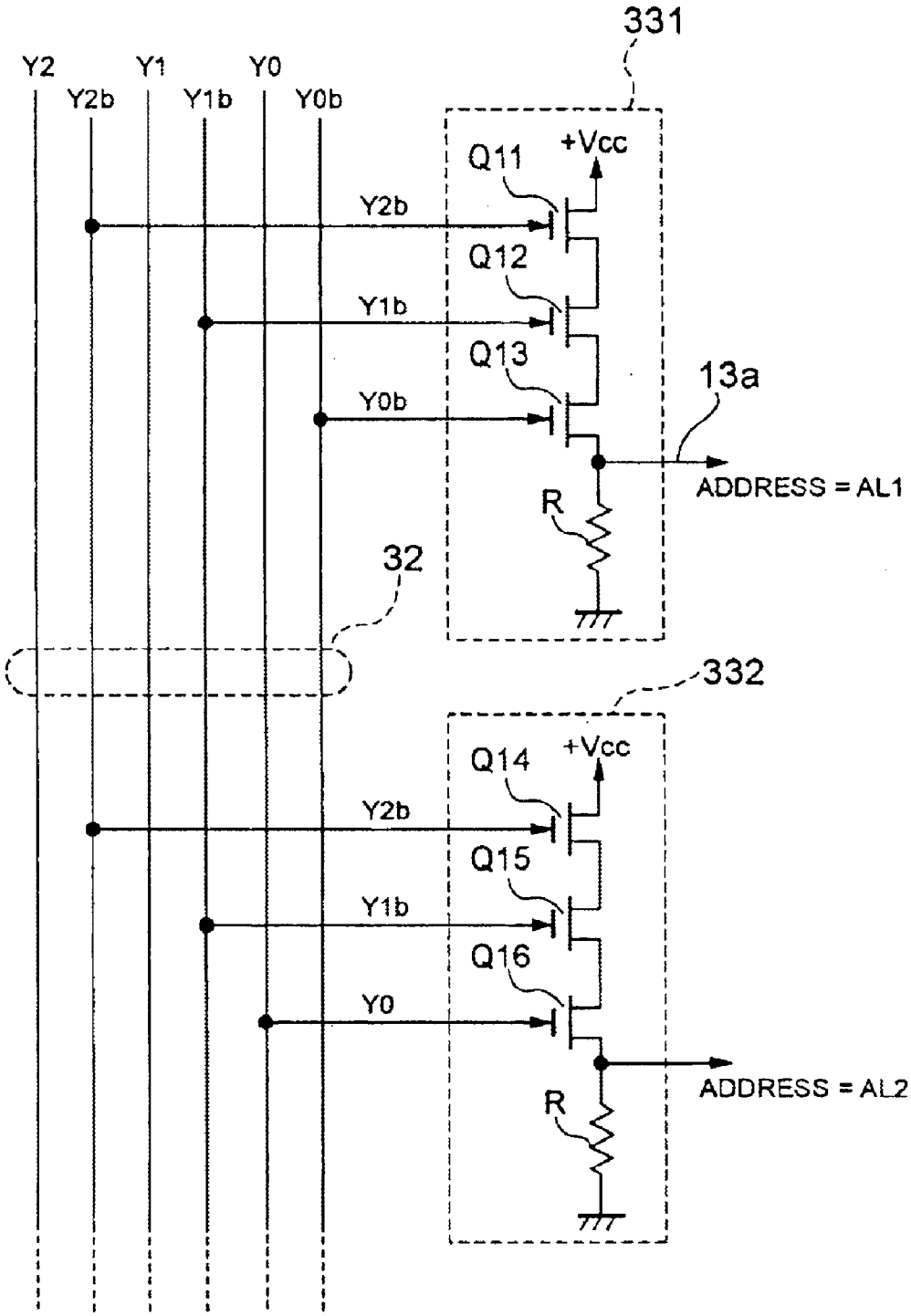
FIG. 4 is a circuit diagram of an address signal generation circuit in the display panel driving device of FIG. 2.

The specific operation and the configuration of the combinatorial logic circuits 33 are further described, referring to the circuit diagram shown in FIG. 4.

In order to facilitate the explanation, in FIG. 4 the control line group 32 is limited to a binary code of 3 bits (n bits: n=3). In this case, the number of addresses which can be decoded from the address signal generation data is given by the following equation:

$$2^n=2^3=8$$

That is 8 rows of addresses, from the address AL1 of the first row represented by the 3-bit binary code "000", to the address AL8 of the eighth row represented by "111". In the circuit shown in FIG. 4, for convenience, only two combinatorial logic circuits 331 and 332 are shown for the addresses AL1 and AL2; but similar combinatorial logic circuits are provided for each of the addresses AL3 to AL8.

In the control line group 32, a 6-bit (2n-bit; n=3) code consisting of the binary codes Y2 (MSB) to Y0 (LSB) and the inverted codes Y2*b* (MSB) to Y0*b* (LSB) are superposed. Hence, as shown in FIG. 5, when decoding of address signals from row 1 to row 8 is performed, of the 6-bit codes superposed on the control line group 32, three bits are always at logic level "1", and the remaining three bits are always "0".

Referring back to FIG. 4, the combinatorial logic circuit 331 (or 332) is a logic product circuit. The combinatorial logic circuit has three N-channel transistors connected in series. A gate terminal of each N-channel transistor is an input terminal of the same N-channel transistor. Therefore, only when all of the three input terminals of the combinatorial logic circuit are at "1" does the power supply voltage +Vcc, that is, logic "1", appear at the source-side terminal of the source follower resistance R which is the output of the combinatorial logic circuit.

In the circuit shown in FIG. 4, the combinatorial logic circuit 331 is the decoding circuit for the first row, that is, for the address AL1, and the combinatorial logic circuit 332 is the decoding circuit for the second row, that is, for the address AL2. The three control lines Y2*b*, Y1*b*, Y0*b* from among the control line group 32 are connected to the gate terminals of the N-channel transistors Q11 to Q13 of the combinatorial logic circuit 331, respectively. Similarly, the three lines Y2*b*, Y1*b*, Y0*b* from among the control line group 32 are connected to the gate terminals of the combinatorial logic circuit 332, respectively.

As is clear from the relationship between the code group and decoding addresses shown in FIG. 5, when the decoding is performed for the address AL1, the logic levels of the three bits of Y2*b*, Y1*b* and Y0*b* are "1", and when the decoding is performed for the address AL2, the logic levels of the three bits Y2*b*, Y1*b* and Y0 are "1". That is, during the decoding at each of the addresses, pulses with logic level "1" are output as address signals from the associated combinatorial logic circuit.

In other words, according to this embodiment, an address signal generation circuit can be provided in a display panel driving device by using combinatorial logic circuits which can be configured from unipolar transistors alone, without using sequential logic circuits such as shift registers. Consequently, amorphous silicon, organic semiconductors, and other semiconductor materials with low cost and enabling easy manufacture can be used as the constituent material of the display panel driving device.

Figure 6:
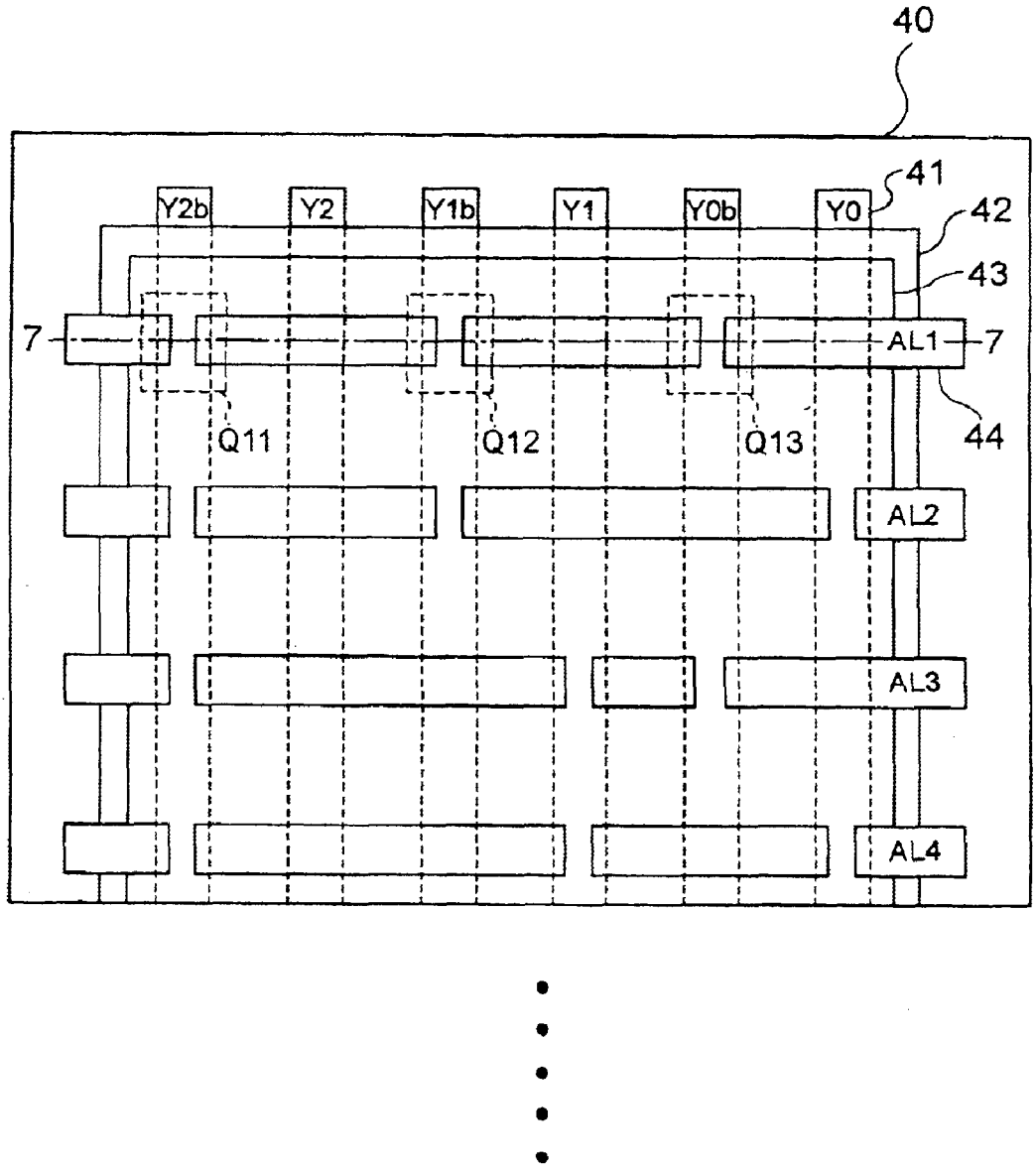
FIG. 6 illustrates a substrate structure of a first example when the circuit of FIG. 4 is mounted on a substrate.
Figure 7:
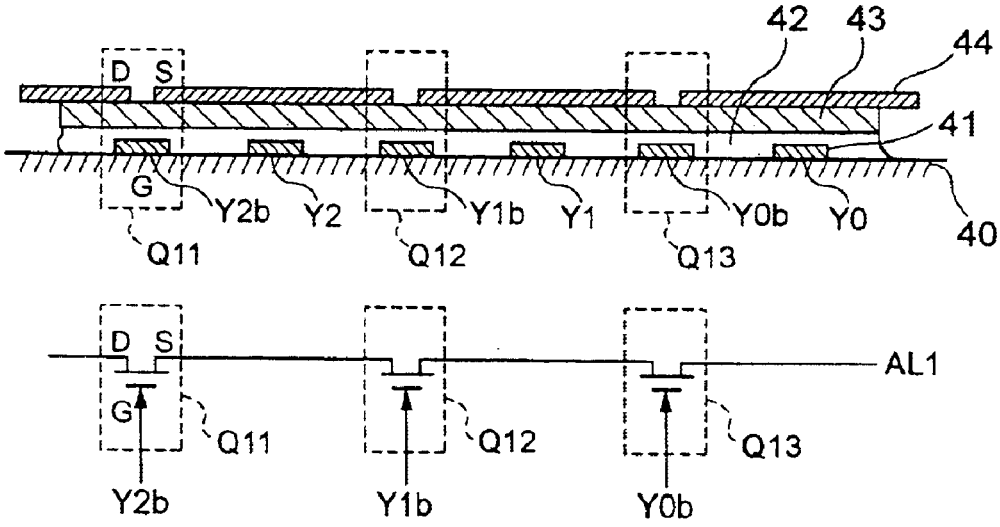
FIG. 7 is a cross-sectional view along the line 7—7 in FIG. 6.

The substrate structure of the circuit of FIG. 4 is shown in FIG. 6, and a cross-sectional view along the line 7—7 in FIG. 6 is shown in FIG. 7.

In FIG. 6 and FIG. 7, the address generation circuit shown in FIG. 4 is formed on the substrate 40. The electrical circuit formed with the substrate structure of FIG. 6 is equivalent to the circuit shown in FIG. 4, but the power supply +Vcc and source follower resistance R in FIG. 4 are omitted for convenience of explanation. It should be noted that there is no need for the substrate and associated parts shown in FIG. 6 to be independent from other parts of the display panel 10; for example, they may be formed together with the display elements of the display panel on a transparent substrate, made from a polymer material or the glass, of the display panel 10.

The data control line pattern 41 for address signal generation (hereafter simply called "the control line pattern 41") physically implements each of the address signal generation data control lines in the control line group 32. The control line pattern 41 is a wiring pattern formed by evaporation deposition of, for example, a copper alloy, aluminum alloy, or other conductive material onto the substrate 40. When the substrate structure shown in FIG. 6 is formed together with the display elements on the transparent substrate of the display panel, transparent electrodes utilizing ITO (indium tin oxide) or similar may be employed as the control line pattern 41.

The insulating film 42 is a thin film of, for example, silicon oxide or silicon nitride, having good insulating properties. The insulating film 42 is in contact with the surface of the substrate 40 and covers the control line pattern 41.

The channel material film 43 is a thin film of p-type or n-type semiconductor material, and is in contact with the insulating film 42. It should be noted that the material for the channel material film 43 may be amorphous silicon, or an organic semiconductor material. Evaporation deposition, printing, vapor-phase growth, or various other thin film fabrication methods may be used to form the insulating film 42 and channel material film 43. That is, the thin film fabrication methods best suited to the materials to be used as the insulating film 42 and as the channel material film 43 may be employed.

The address electrode extension line pattern 44 (hereafter called "the extension line pattern 44") is the implementation on the substrate of the extension lines 13*a* of the address electrodes 13 in the circuit of FIG. 4. The extension line pattern 44, similar to the control line pattern 41, is formed by performing evaporation deposition or similar on the channel material film 43 of aluminum alloy or another conductive material. The extension line pattern 44 is extended, and is connected with the address electrode 13 of each row of the display panel 10.

As shown in FIG. 6, the lines of the extension line pattern 44 are positioned so as to intersect with the lines of the control line pattern 41 perpendicularly. As is clear from FIG. 6 and FIG. 7, the extension line pattern 44 is not a single continuous wiring pattern, but has disconnected portions at prescribed positions where the extension line pattern 44 crosses the control line pattern 41. The extension line pattern 44 extends above the control line pattern 41.

Next, the principle of operation of the driving device according to this embodiment is described, referring to FIG. 6 and FIG. 7.

In this embodiment, the compound film layer of the insulating film 42 and channel material film 43 formed on the substrate 40 is enclosed between two metal electrodes (i.e., the control line pattern 41 and the extension line pattern 44) in a MOS structure. Hence, as shown in the cross-sectional diagram of FIG. 7, at each of the disconnected points of the intersections of the two metal electrodes (at the disconnected portions of the extension line pattern 44), a field effect transistor due to the MOS structure is formed naturally.

This may be described as follows, taking as an example the transistor Q11 shown in the cross-sectional view of FIG. 7.

In the transistor Q11, the control line pattern 41 (more specifically, the address signal generation data control line Y2*b*) becomes the gate terminal G of the transistor, and the two disconnected end portions of the extension line pattern 44 become the drain terminal D and the source terminal S of the transistor. A channel region in which charge moves is formed in the channel material film 43 existing below the address electrode disconnected portion between the drain D and source S. Movement of charge in the channel region is controlled by the potential of the gate electrode G via the insulating film 42. If the semiconductor material used in the channel material film 43 is n-type, an N-channel transistor is formed as the transistor Q11; if p-type, a P-channel transistor is formed.

In the extension line pattern 44, the portions in which the pattern is connected, other than the disconnected portions, are ordinary wiring patterns. Hence, by means of this wiring pattern, the drain of a transistor and the source of an adjacent transistor formed over a disconnected portion of the extension line pattern 44 are electrically connected to each other. That is, all of the transistors formed at the disconnected portions of the extension line pattern 44 are connected in series, as shown in FIG. 7. For example, on the address electrode AL1 of the extension line pattern 44, series connections of the transistors Q11, Q12, Q13 are obtained, with the gate terminals of these three transistors being connected to the control lines Y2*b*, Y1*b*, Y0*b*, respectively.

If n-type semiconductor material is used in the channel material film 43, then the electrical circuit formed on the address electrode AL1 in the extension line pattern 44 is a circuit with series-connected N-channel transistors Q11, Q12, Q13. The series-connected circuit of these N-channel transistors is the logic product circuit of the combinatorial logic circuit 331 shown in FIG. 4.

As described above, in this embodiment the MOS structure itself which is formed from the control line pattern 41, the extension line pattern 44, and the compound film layer between these two line patterns 41 and 44 is provided with the functions of a combinatorial logic circuit. Consequently, there is no need to provide combinatorial logic circuits on the substrate 40, nor is there a need to provide through-holes to connect the combinatorial logic circuits with the control line pattern 41. Thus, the substrate structure of the display driving device can be simplified and made compact.

The present invention is not limited to the above-described embodiment. For example, the following modifications can be made. A first modified embodiment of a display panel driving device is described below with reference to FIG. 8 and FIG. 9.

Figure 8:
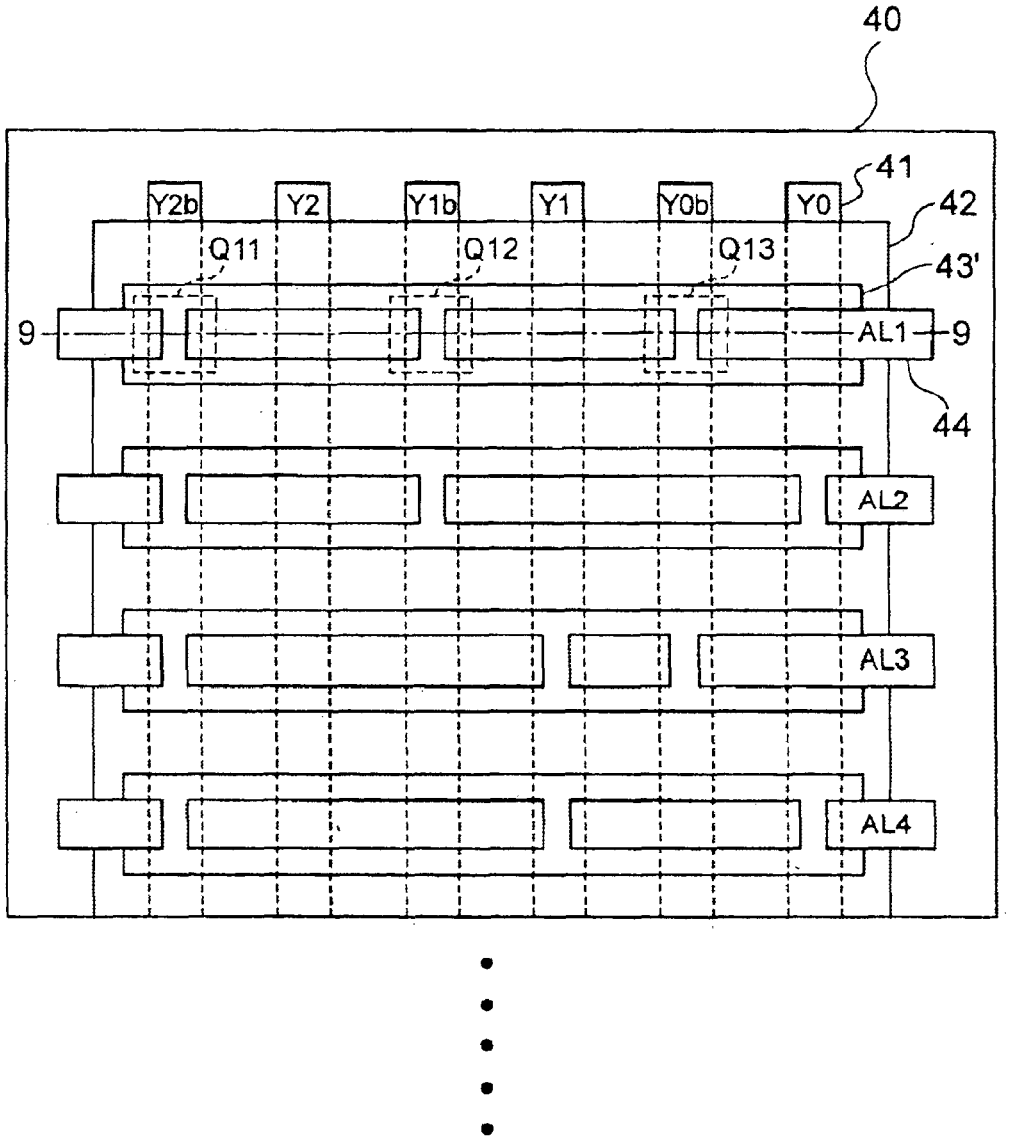
FIG. 8 illustrates a substrate structure of a second example when the circuit of FIG. 4 is mounted on the substrate.
Figure 9:
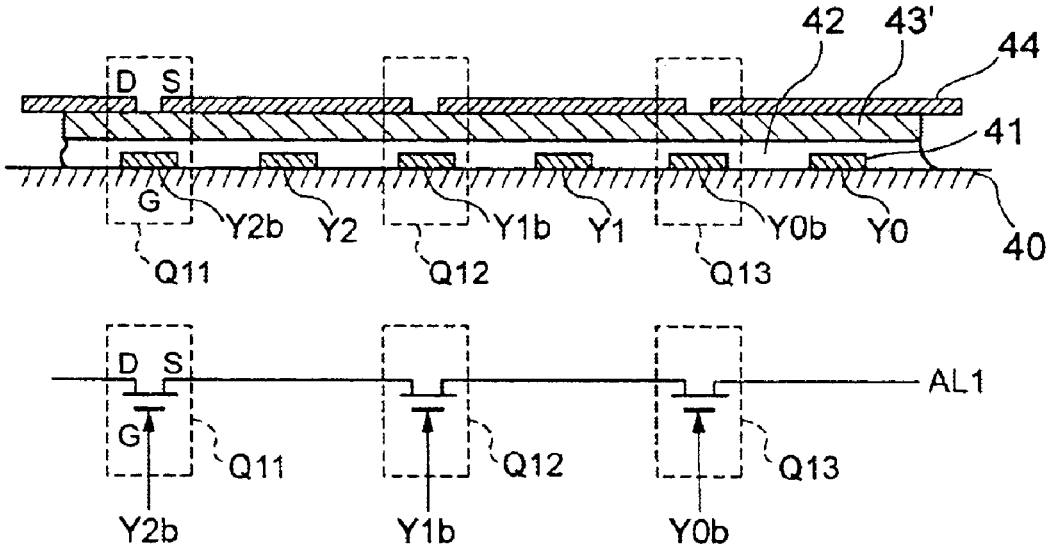
FIG. 9 is a cross-sectional view along the line 9—9 in FIG. 8.

The substrate structure of the display panel driving device of the first modified embodiment is shown in FIG. 8. The cross-sectional view along the line 9—9 in FIG. 8 appears in FIG. 9.

As is clear from FIG. 8, the channel material film 43' in this modification is different from the channel material film 43 in the above described embodiment (FIG. 6). Although the channel material film 43 is provided on top of the entire region of the insulating film 42 in the above-described embodiment, the channel material film 43' is separated (divided) for each of the address electrodes along each line of the extension line pattern 44. This is the only difference between this modification and the above-described embodiment, and so an explanation of the structure and operation of the driving device according to this modification is omitted.

Separation of the channel material film 43' may be performed by, for example, selective application in the process of formation of the channel material film 43'; or, partition walls of silicon oxide or similar may be provided on the insulating film 42 to separate the channel material film 43'.

In the modification of FIG. 8, the lines of the extension line pattern 44 are separated from each other, so that interference between the address electrodes can be completely prevented. Also, the area of fabrication of the channel material film 43' can be reduced, thus also contributing to reducing manufacturing costs.

Next, a second modification is described with reference to FIG. 10 and FIG. 11.

Figure 10:
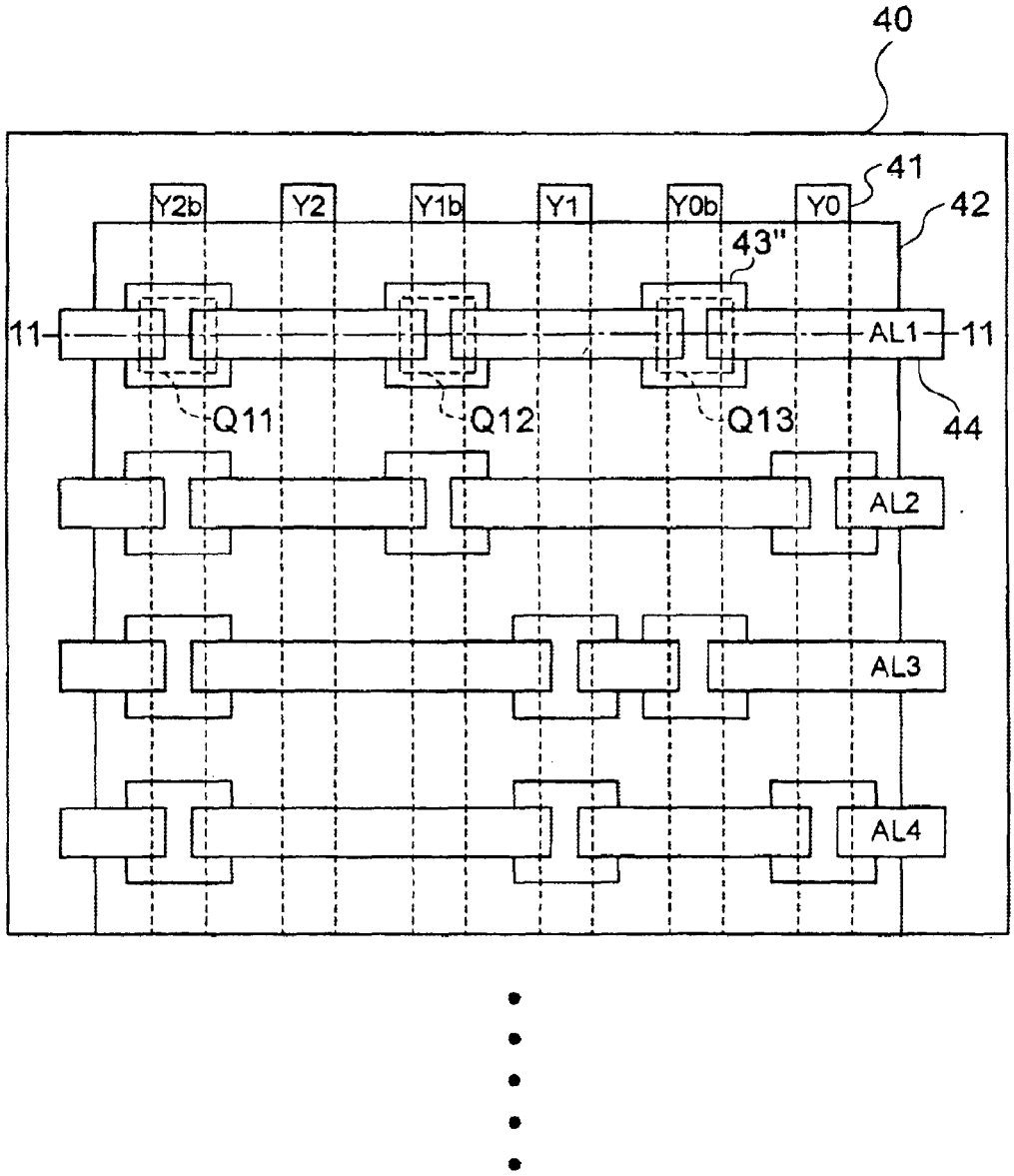
FIG. 10 illustrates a substrate structure of a third example when the circuit of FIG. 4 is mounted on the substrate.

The structure of the substrate of the display panel driving device of the second modification is shown in FIG. 10. FIG. 11 shows a cross-sectional view along the line 11—11 in FIG. 10.

Figure 11:
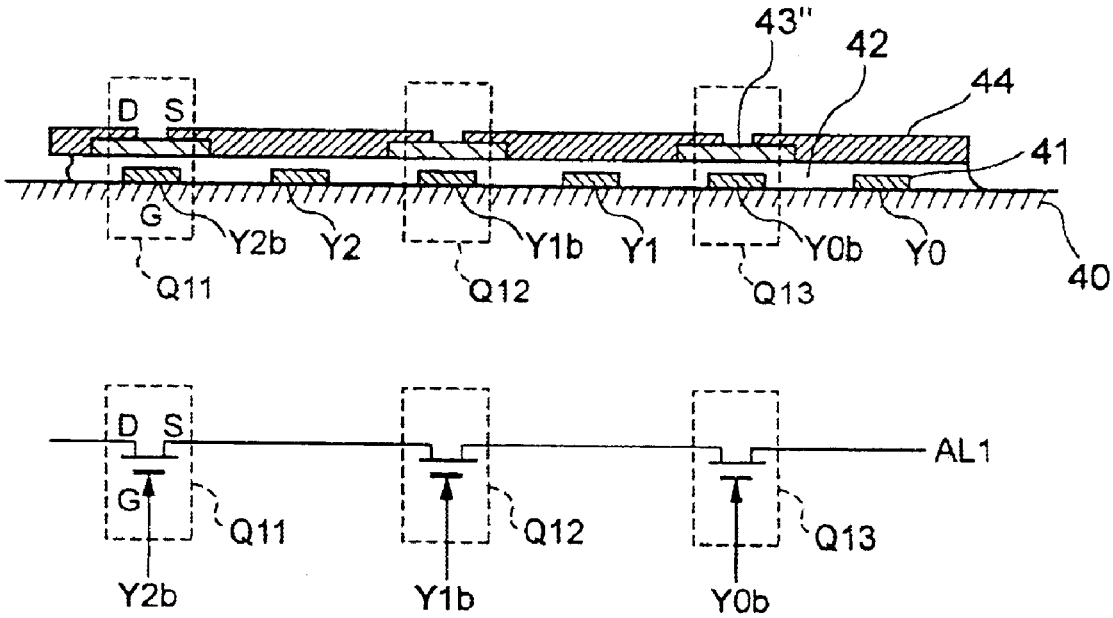
FIG. 11 is a cross-sectional view along the line 11—11 in FIG. 10.

As is clear from FIG. 10 and FIG. 11, a characteristic of the second modification is individual provision of the channel material film 43" only on the transistor element formation portion of the extension line pattern 44. If the second modification is compared with the first modification (FIG. 8), the area of the channel material film formed along each line of the extension line pattern 44 in the first modification is reduced in the second modification. The channel material film 43" is provided only in the disconnected portions of the extension line pattern 44 in the second modification. The difference of this second modification with the above-described embodiment and the first modification lies in this point only, and so an explanation of the structure and operation of the driving device according to the second modification is omitted.

In the second modification, the transistors formed along each address electrode are separated from each other, so that interference between the transistor elements can be completely eliminated. Further, locations of the channel material film 43" are limited to portions at which transistor elements are formed, so that manufacturing costs can be further reduced.

The display panel driving device of the present invention is not limited to the embodiment and modifications described above.

Figure 12:
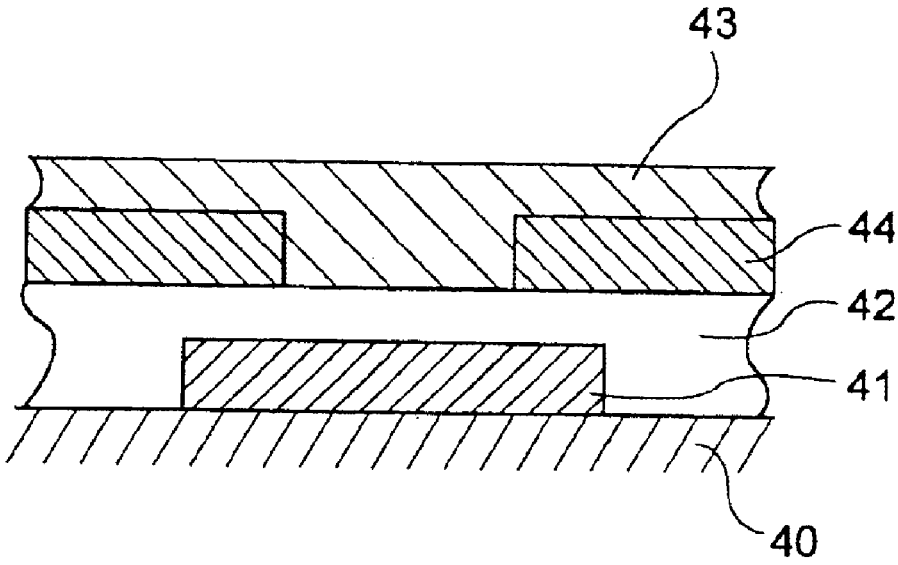
FIG. 12 illustrates a substrate structure according to a modified embodiment of the present invention.

For example, in the embodiment and modifications of FIG. 1 through FIG. 11, the extension line pattern 44 extends on the channel material film 43; but as shown in FIG. 12, the extension line pattern 44 may be provided on only the insulating film 42 such that the extension line pattern 44 may be submerged (embedded) below the channel material film 43.

Figure 13:
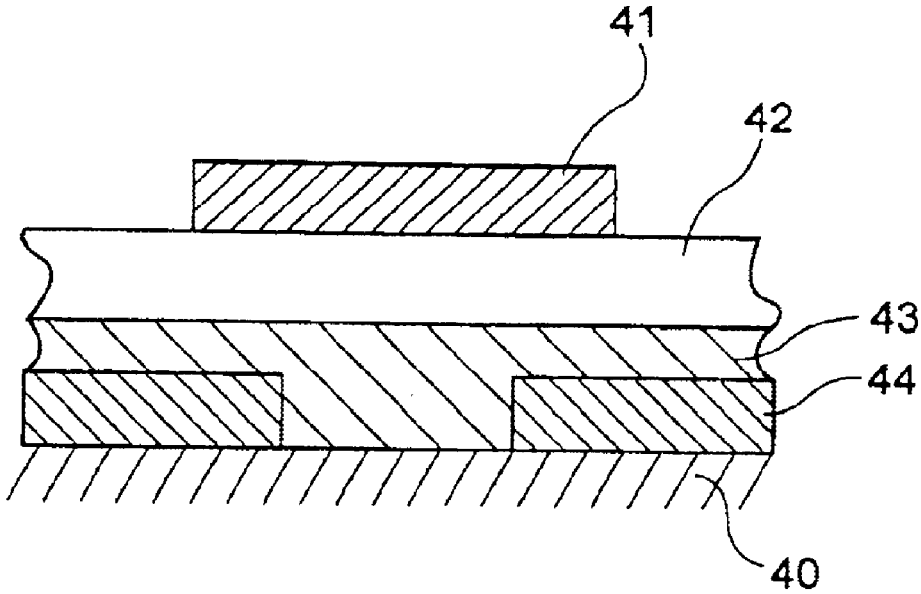
FIG. 13 illustrates a substrate structure according to another modified embodiment of the present invention.

Also, in the embodiment and modifications of FIG. 1 through FIG. 11, the control line pattern 41 is provided on the substrate 40, the compound film layer (42, 43) is formed over the control line pattern 41, and the extension line pattern 44 is formed on the compound film layer; however, this structure may be inverted as shown in FIG. 13. Specifically, the extension line pattern 44 may be formed on the substrate 40, the channel material film 43 may extend over the extension line pattern 44, the insulating film 42 may extend over the channel material film 43, and the control line pattern 41 may be formed on the insulating film 42. In the case of this structure also, any of the channel material film 43 (FIG. 6), 43' (FIG. 8) or 43" (FIG. 10) may be employed.

By de Morgan's theorem, it is known that a logic product based on positive logic is equal to a logic sum based on negative logic. Hence, if the operation of the address generation circuit of the present invention is established as negative logic, and p-type semiconductor material is used as the channel material film 43, then a substrate structure for a display panel driving device which employs logic sum circuits using P-channel transistors can be provided.

As has been described in detail above, amorphous silicon material or organic semiconductor material can be used for the display panel driving device, and the substrate structure can be simplified. Consequently it is possible to decrease the size and reduce the costs of the display panel driving device.

Second Embodiment

Figure 14:
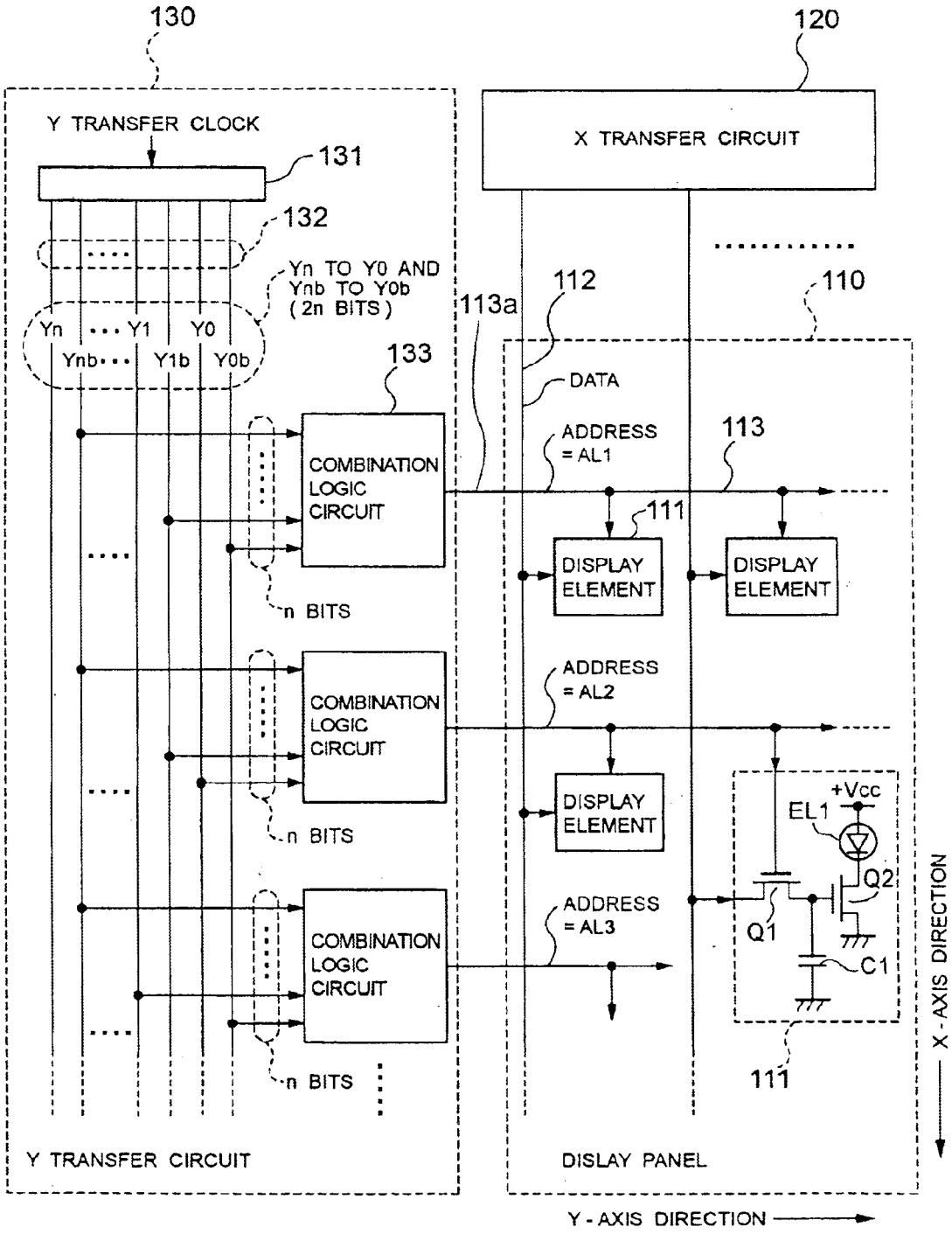
FIG. 14 is a block diagram showing the configuration of the display panel driving device of a second embodiment of the present invention.

FIG. 14 shows a second embodiment of a display panel driving device of the present invention. Similar reference numerals are used to designate similar elements in the first and second embodiments.

As shown in FIG. 14, display elements 111 are arranged in matrix form on the surface of the display panel 110. Each of the display elements 111 primarily includes a light-emitting element EL1, a data-writing transistor Q1, a light-emitting element driving transistor Q2, and a storage capacitor C1. Here, the light emission operation in the light-emitting element 111 is described as follows. The data-writing transistor Q1 is turned on by a Y transfer pulse (address signal) superposed on an address electrode 113 with prescribed timing. At this time, electric charge due to an X transfer pulse (data signal) superposed on the data electrode 112 is accumulated in the capacitor C1 via the data-writing transistor Q1. When the capacitor C1 has accumulated charge, this charge causes the gate potential of the driving transistor Q2 to be at a high potential, so that the driving transistor Q2 is turned on, and a driving current from the power supply at voltage +Vcc is supplied to the light-emitting element EL1, causing the light-emitting element EL1 to emit light.

Next, the display panel driving device is described. An important aspect of the display panel driving device is the substrate structure of the Y transfer circuit 130. Hence, in this specification, only the configuration of the Y transfer circuit 130 will be described. Lines 113*a* extending to the display panel 110 from the Y transfer circuit 130 are referred to as extension lines of the address electrodes 113. These extension lines 113*a* connect to the address electrodes 113 of the display panel 110, respectively.

The Y transfer circuit 130 is an address signal generation circuit which generates address signals to select display element groups in each row of the display panel 110, in sync with the Y transfer clock (approximately 28.8 kHz) supplied from the control device (not shown) of the display panel 110. The generated address signals are shown in the time chart of FIG. 15.

Figure 15:
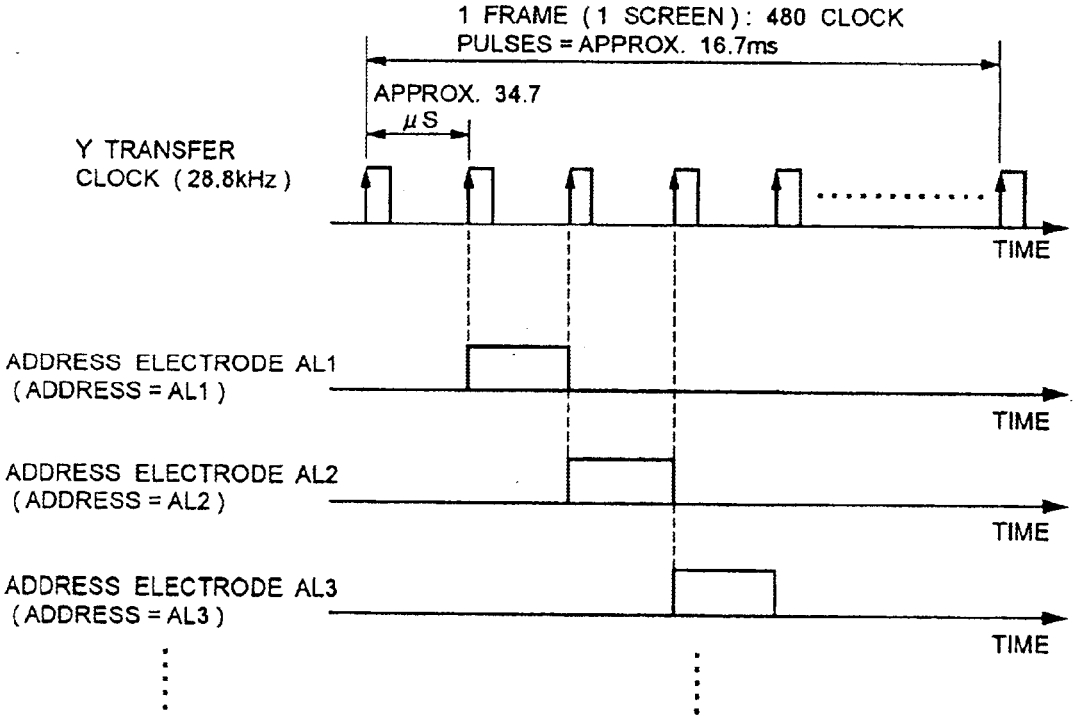
FIG. 15 is a time chart indicating the operation of the display panel driving device of FIG. 14.

As shown in FIG. 15, the Y transfer circuit 130, which is an address signal generation circuit (hereafter, for convenience of explanation, the Y transfer circuit 130 is called the address signal generation circuit), generates scan pulses to sequentially select 480 rows of display element groups arranged on the display panel 110, during an interval of approximately 16.7 ms (1/60 Hz) which is the time of one screen (one frame) displayed on the display panel. The address signal generation circuit 130 generates an address signal (or the scan pulse) in sync with a Y transfer clock, and supplies the address signal to each of the display element groups on the rows of the display panel.

Next, the internal configuration of the address signal generation circuit 130 is described. As shown in FIG. 14, the address signal generation circuit 130 includes a data control line group 132 (hereafter simply referred to as "control line group 132") for address signal generation, an address signal generation data supply circuit 131 (hereafter referred to as "supply circuit 131") to supply address signal generation data to the control line group 132, a plurality of combinatorial logic circuits 133, and a plurality of address electrodes 113. The address signal generation data is superposed on the control line group 132. The address signal generation data is a code group, and serves as the basis for generating the address signals. That is, the supply circuit 131 counts Y transfer clock pulses using, for example, a 480-ary binary counter, and generates pulse signals for each of the $2^0$ to $2^n$ digits, as well as inverted pulse signals for each of these digits. These pulse signals are then arranged in 2n-bit codes and used as the above-mentioned code group.

In the embodiment shown in FIG. 14, 480 rows of display element groups are arranged in the Y-axis direction on the display panel 110. Hence, the number of bits of binary code required to generate row addresses for each of the rows 1 to 480 is determined by the following relation:

$$512>480>256$$

that is, $$2^9>480>2^8$$

Thus, a binary code of length 9 bits is sufficient.

Hence, the supply circuit 131 can be constructed from a 480-ary binary counter which counts Y transfer clock pulses, and an inverter circuit (neither shown in the figure). In FIG. 14, address signal generation data generated by the supply circuit 131 includes an 9-bit binary code (n-bit; n=9) and the inverted code of the same. A code with 18 bits (2n bits) is supplied to the control line group 132. In other words, the control line group 132 includes 18 control lines, on which are superposed 9-bit binary codes Y8 (MSB) to Y0 (LSB), and the inverted codes Y8*b* (MSB) to Y0*b* (LSB) of the same.

As described above, in order to count Y transfer clock pulses (approximately 28.8 kHz), one count step for the 480-ary binary counter is approximately 34.7 $\mu$s, which is one period of the Y transfer clock, as shown in FIG. 15. The time required for 480 counts or one complete revolution of the count value of the 480-ary binary counter is approximately 16.7 ms (approximately 34.7 $\mu$s×480 steps), which is the time of one frame of the display screen.

The combinatorial logic circuit 133 includes AND gates, OR gates, and other logic gate circuits, and is required on each row of the display panel 110. Hence, in the embodiment shown in FIG. 14, 480 combinatorial logic circuits are required, corresponding to the 480 address electrodes 113 for the first to 480th rows. 9-bit (n-bit; n=9) control lines, from the control line group 132, are connected to each of the combinatorial logic circuits 133. Each of the combinatorial logic circuits 133 uses the code consisting of nine bits to output a selection signal (i.e., an address signal) for the associated address electrode 113 of the display panel 110.

Figure 16:
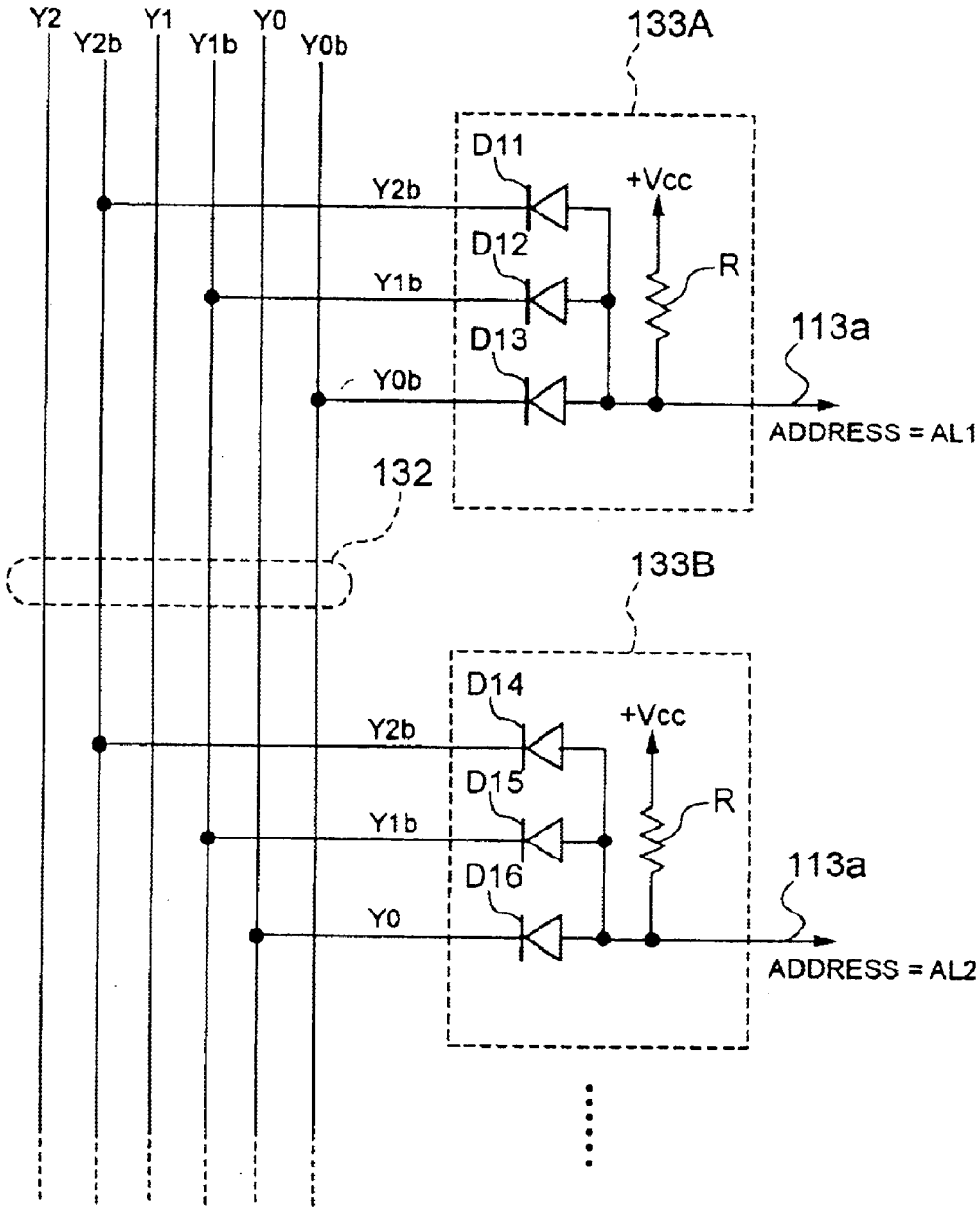
FIG. 16 is a circuit diagram of an address signal generation circuit of the panel display driving device of FIG. 14.

The specific operation and the configuration of the combinatorial logic circuit 133 are further described, referring to the circuit diagram shown in FIG. 16.

For the sake of description, in FIG. 16 the control line group 132 is limited to a binary code of 3 bits (n bits; n=3). In this case, the number of addresses which can be decoded from the address signal generation data is:

$$2^n=2^3=8$$

That is, this is 8 rows, from the address AL1 of the first row represented by the 3-bit binary code "000", to the address AL8 of the eighth row represented by the 3-bit binary code "111". In the circuit shown in FIG. 16, for convenience only two combinatorial logic circuits 133A and 133B for the addresses AL1 and AL2 are shown; but similar combinatorial logic circuits are provided for the addresses AL3 to AL8, respectively In the control line group 132, a 6-bit code (2n-bit; n=3) consisting of the binary codes Y2 (MSB) to Y0 (LSB) and the inverted codes Y2*b* (MSB) to Y0*b* (LSB) are superposed. Hence, as shown in FIG. 17, when decoding of address signals from row 1 to row 8 is performed, of the 6-bit codes superposed on the control line group 132, three bits are always at logic level "1", and the remaining three bits are always "0".

As shown in the circuit of FIG. 16, in each combinatorial logic circuit three diodes are connected in parallel with a common anode. Each of the cathodes of the three diodes is an input terminal. This is a logic product circuit. Only when all of the three input terminals of the combinatorial logic circuit are at "1" are all the diodes turned off, so that the potential of the power supply voltage +Vcc, that is, a logic "1", appears via a resistance R at the common anode which is the output of the combinatorial logic circuit.

In FIG. 16, the combinatorial logic circuit 133A is the decoding circuit for the first row, that is, for the address AL1, and the combinatorial logic circuit 133B is the decoding circuit for the second row, that is, for the address AL2. Three control lines Y2*b*, Y1*b*, Y0*b* from among the control line group 132 are connected to the cathodes of the three diodes D11 to D13 of the combinatorial logic circuit 133A, respectively. Similarly, three lines Y2*b*, Y1*b*, Y0 from among the control line group 132 are connected to the three cathodes of the combinatorial logic circuit 133B, respectively.

As clear from the relationship between the code group and decoding addresses shown in FIG. 17, when decoding is performed at the address AL1, the logic levels of the three bits of Y2*b*, Y1*b*, Y0*b* are "1", and when decoding is performed at the address AL2, the logic levels of the three bits Y2*b*, Y1*b*, Y0 are "1". Hence, when the code group designates one address, a pulse at logic level "1" is output as an address signal from the combinatorial logic circuit corresponding to the designated address to the address electrode 113.

In this embodiment, therefore, the address signal generation circuit in the display panel driving device can be provided using combinatorial logic circuits which can be configured using diodes only, without using shift registers or other sequential logic circuits. Consequently, amorphous silicon, organic semiconductors, and other semiconductor materials with low cost and enabling easy manufacture can be used as the constituent material of the display panel driving device.

Figure 18:
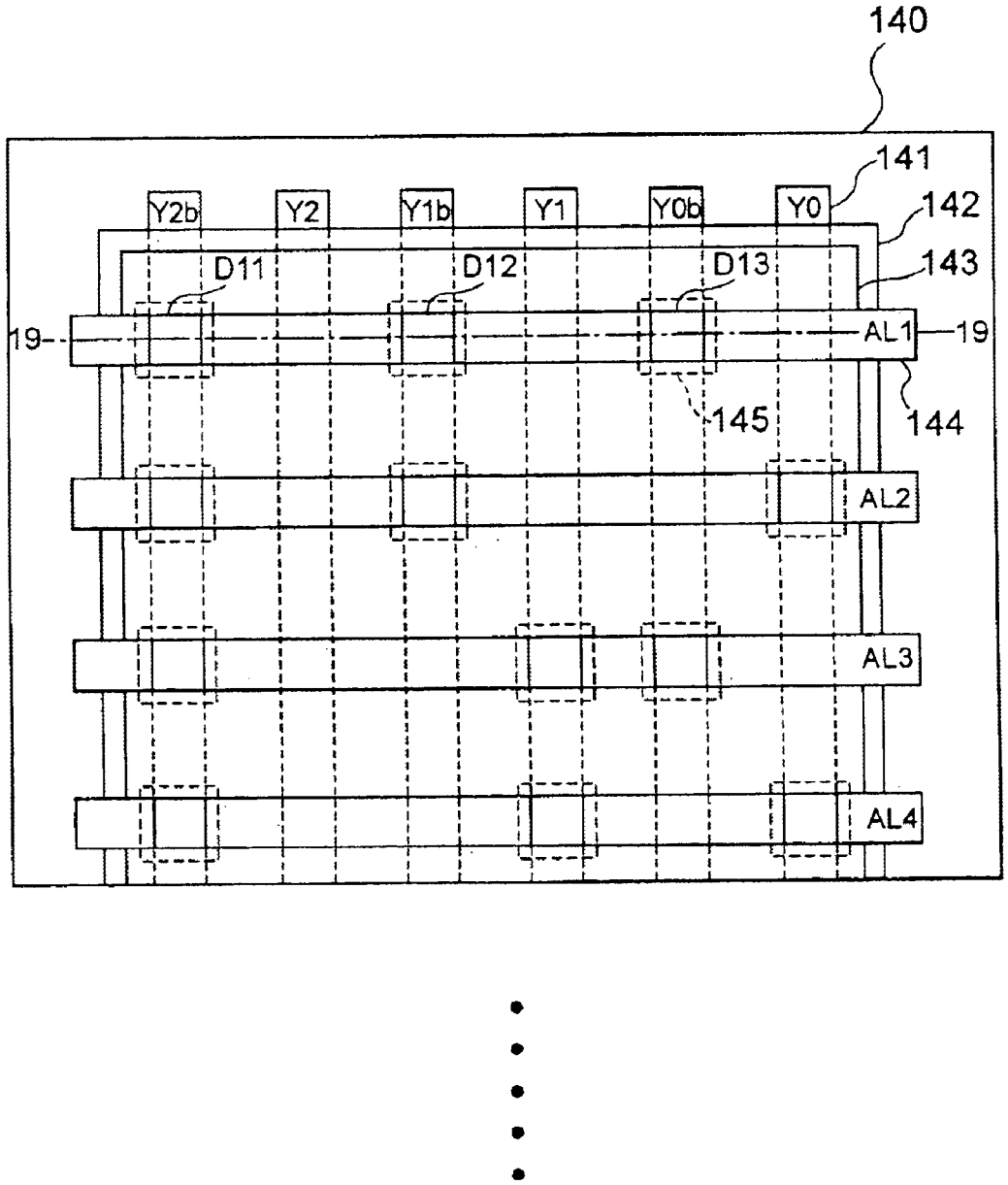
FIG. 18 illustrates a substrate structure of a first example when mounting the circuit of FIG. 16 on a substrate.
Figure 19:
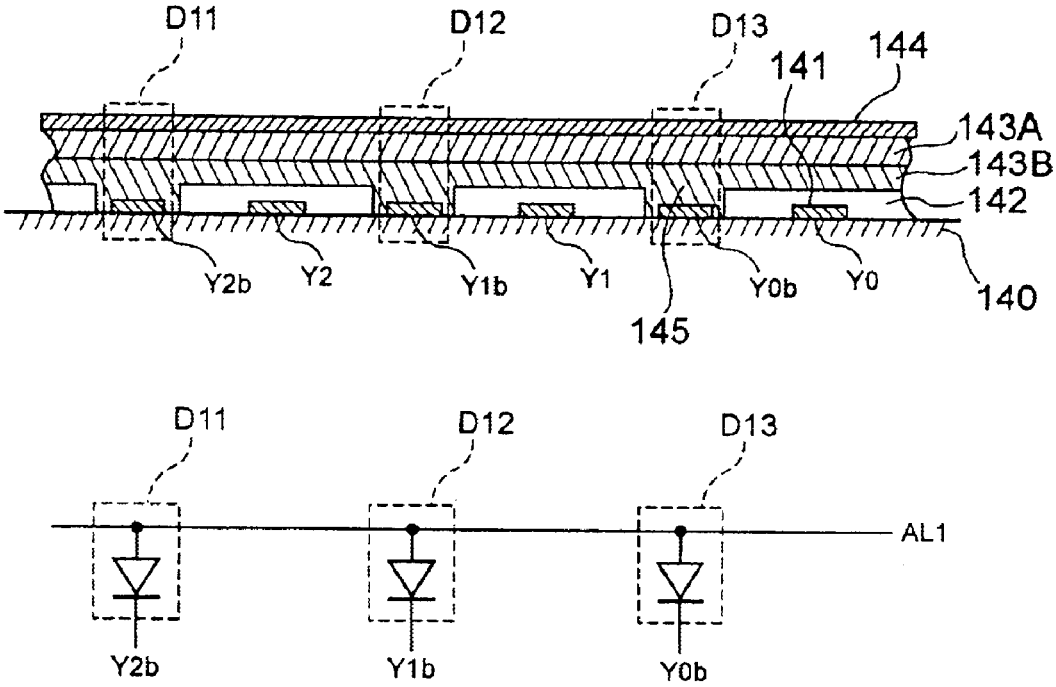
FIG. 19 is a cross-sectional view along the line 19—19 in FIG. 18.

The substrate structure of the combinatorial logic circuit shown in FIG. 16 is illustrated in FIG. 18, and a cross sectional view along the line 19—19 in FIG. 18 is illustrated in FIG. 19.

In FIG. 18 and FIG. 19, the address generation circuit shown in FIG. 16 is formed on the substrate 140. The electrical circuit formed with the substrate structure of FIG.

18 is equivalent to the circuit shown in FIG. 16, but the power supply +Vcc and resistance R in FIG. 16 are omitted for convenience of description. It should be noted that there is no need for the substrate structure (substrate 140 and associated parts) shown in FIG. 18 to be independent from other parts of the driving device; for example, the substrate structure may be formed together with display elements of the display panel 110 on a transparent substrate, made from a polymer material or the glass, of the display panel 110.

The data control line pattern 141 for address signal generation (hereafter simply called "the control line pattern 141") physically implements each of the address signal generation data control lines which form the control line group 132. The control line pattern 141 is a wiring pattern formed by evaporation deposition of, for example, a copper alloy, aluminum alloy, or other conductive material onto the substrate 140. When the substrate structure shown in FIG. 18 is formed together with display elements on the transparent substrate of the display panel, transparent electrodes utilizing ITO (indium tin oxide) or similar may be employed as the control line pattern 141.

The insulating film 142 is a thin film of, for example, silicon oxide or silicon nitride, having good insulating properties. The insulating film 142 is provided in contact with the surface of the substrate 140 and covers the control line pattern 141.

The diode functional film 143 is a thin film having so-called diode functions exhibiting unidirectional conductivity. The diode functional film 143 is provided in contact with the insulating film 142, and includes a layering of a p-type semiconductor material layer 143A and an n-type semiconductor material 143B. By means of a PN junction defined by the p-type semiconductor material film 143A and the n-type semiconductor material film 143B, a diode is formed in the diode functional film 143, with the film 143A being an anode and the film 143B being a cathode. The material of the p-type semiconductor material film 143A and n-type semiconductor material film 143B is, for example, amorphous silicon material, or organic semiconductor material.

Methods for forming the insulating film 142 and diode functional film 143 on the substrate 140 include evaporation deposition, printing, vapor phase growth, or any other suitable thin film fabrication methods. The thin film fabrication methods best suited to the materials used in the insulating film 142 and diode functional film 143 may be used.

The address electrode extension line pattern 144 (hereafter called "the extension line pattern 144") is the implementation on the substrate 140 of the extension lines 113*a* of the address electrodes 113 in the circuit of FIG. 16. The extension line pattern 144, similar to the control line pattern 141, is formed by performing evaporation deposition or a similar process on the diode functional film 143 of aluminum alloy or another conductive material. The extension line pattern 144 is extended, and is connected with the address electrodes 113 of the respective rows of the display panel 110.

As shown in FIG. 18, the lines of the extension line pattern 144 perpendicularly intersect the lines of the control line pattern 141. As is clear from FIG. 18 and FIG. 19, the insulating film 142 has apertures 145 at some of intersection positions at which the lines of the extension line pattern 144 and the lines of the control line pattern 141 intersect.

Next, the operation of this embodiment is described, referring to FIG. 18 and FIG. 19.

In this embodiment, PN junction diodes, each including a p-type semiconductor material film 143A and an n-type semiconductor material film 143B, are connected between the control line pattern 141 and extension line pattern 144 at the apertures 145 of the insulating film 142.

This situation can be described as follows, taking as an example the diode D11 shown in the cross-sectional diagram of FIG. 19.

In the diode D11, the control line pattern 141 (more specifically, the data control line Y2*b* of the control line pattern 141) is connected to the cathode of the diode D11, and the extension line pattern 144 is connected to the anode of the diode D11. Each line of the extension line pattern 144 is a single wiring pattern, so that the anodes of all the diodes formed at the apertures 145 are connected in parallel via the associated line of the extension line pattern 144.

The anodes of the diodes formed along the line of the extension line pattern 144 are all connected in parallel, as shown in FIG. 19. For example, the line of the extension line pattern 144 for the address AL1 forms a diode array in which the anodes of the diodes D11, D12, D13 are all connected in parallel. The cathodes of the diodes D11, D12, D13 are connected to the control lines Y2*b*, Y1*b*, Y0*b*, respectively. Hence, the electrical circuit formed along the extension line pattern 144 for the address AL1 is equivalent to the logic product circuit in the combinatorial logic circuit 133A shown in FIG. 16.

In this embodiment, therefore, the circuit formed by the control line pattern 141, extension line pattern 144, and the diode functional film 143 between these two patterns at the apertures 145 of the insulating film 142 can be provided with the functions of the combinatorial logic circuit shown in FIG. 16. Consequently, there is no longer a need to separately provide combinatorial logic circuits on the substrate 140. Of course, there would be no need to provide through-holes to connect such combinatorial logic circuits with the control line pattern 141. Thus, the substrate structure of the display panel driving device can be simplified and made compact.

Figure 20:
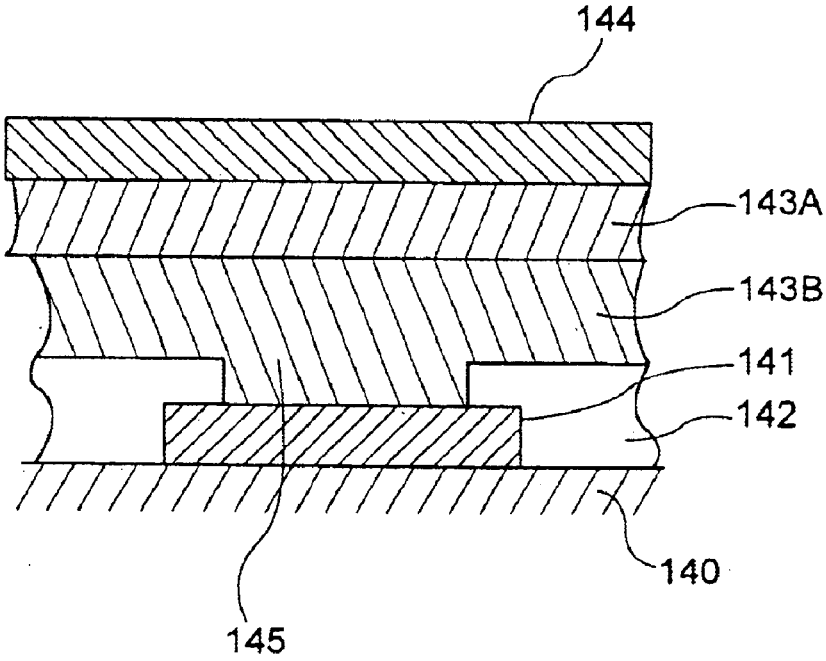
FIG. 20 is a partial cross sectional view of a substrate structure according to a modification made to the substrate structure shown in FIG. 18 and FIG. 19.

The above described second embodiment is not limited to the structure shown in FIG. 18 and FIG. 19; for example, as shown in FIG. 20, part of the control line pattern 141 may extend below the insulating film 142. Other modifications will be described next.

A second modification of the display panel driving device (particularly, the substrate structure) of the second embodiment (FIG. 14 through FIG. 19) is described with reference to FIG. 21 and FIG. 22.

Figure 21:
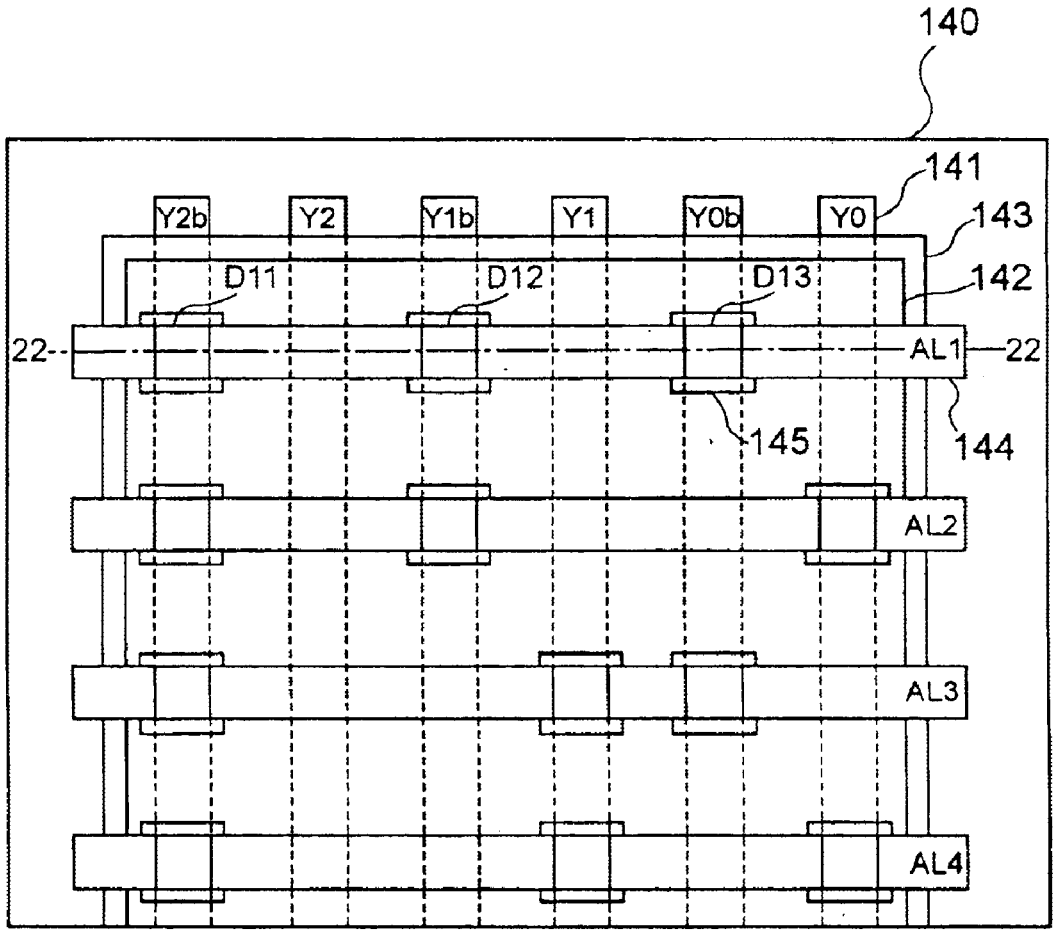
FIG. 21 shows a substrate structure of a second example when mounting the circuit of FIG. 16 on the substrate.
Figure 22:
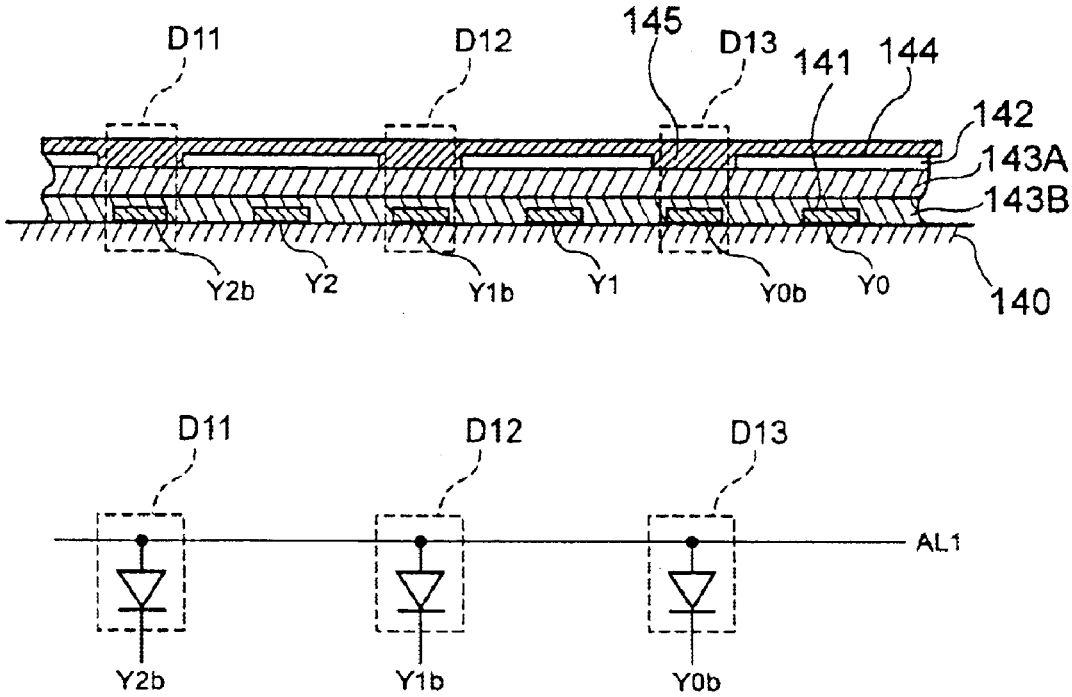
FIG. 22 is a cross-sectional view along the line 22—22 in FIG. 21.

FIG. 21 shows the substrate structure, and FIG. 22 shows a cross-sectional view along the line 22—22 in FIG. 21.

As shown in FIG. 22, in the substrate structure of this modification, an n-type semiconductor material film 143B, p-type semiconductor material film 143A, and insulating film 142 are deposited in order on the substrate 140. The extension line pattern 144 is in contact with the p-type semiconductor material film 143A via the apertures 145 provided at prescribed positions in the insulating film 142. Consequently, a plurality of PN junction diodes, made by the diode functional film 143, are connected between the extension line pattern 144 and control line pattern 141 at the aperture portions 145. The extension line pattern 144 extends above the aperture portions 145, and the control line pattern 141 extends below the aperture portions 145.

That is, in the second modification, the order of layering of the insulating film 142 and diode functional film 143 in the above-described second embodiment is interchanged. This is the only structural difference between this modification and the second embodiment, and so an explanation of the structure and operation of the second modification is omitted.

The display panel driving device of the second embodiment is not limited to the above-described examples.

For example, in any of the substrate structures shown in FIG. 14 to FIG. 22, the vertical positional relationship of the extension line pattern 144 and control line pattern 141 may be inverted. Specifically, the extension line pattern 144 may be provided on the substrate 140, and the control line pattern 141 on top, with the insulating film 142 and diode functional film 143 enclosed therebetween.

Also, in FIG. 14 to FIG. 22, the diode functional film 143 is provided over the entire upper or lower surface of the insulating film 142; but the area over which the diode functional film 143 is provided may be limited to a prescribed range.

Figure 23:
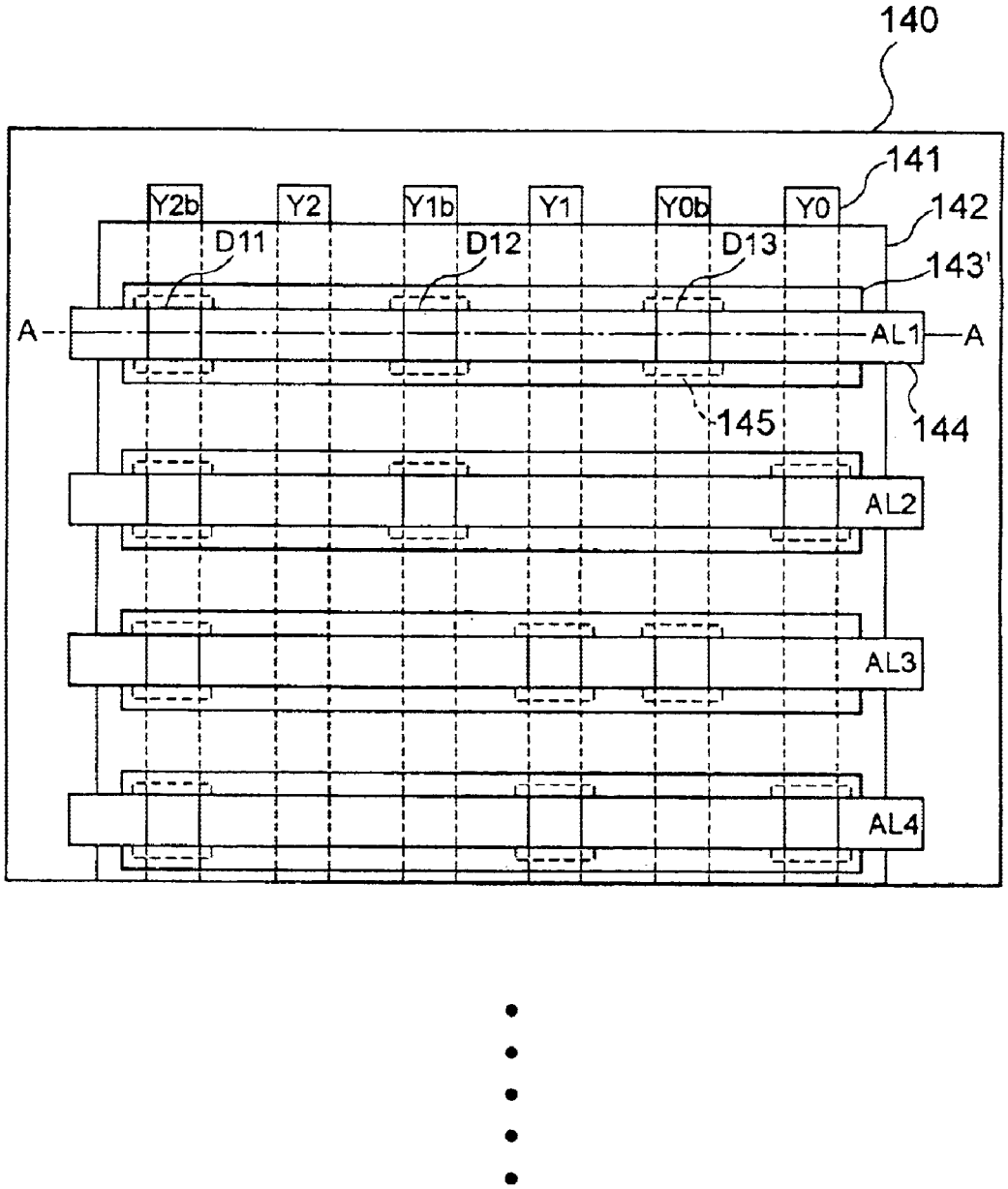
FIG. 23 shows a modified embodiment of the substrate structure shown in FIG. 18 and FIG. 19.
Figure 24:
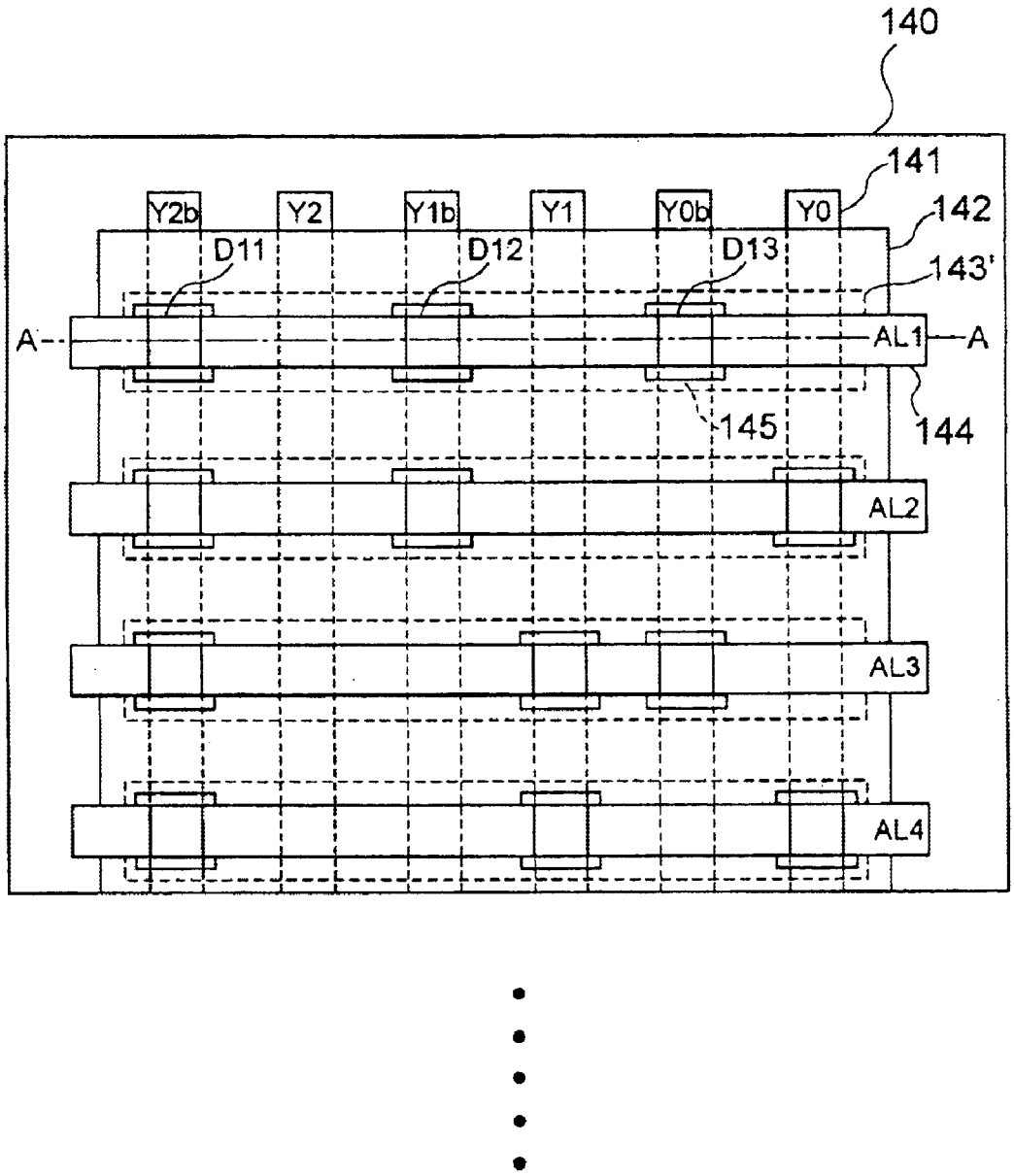
FIG. 24 shows a modified embodiment of the substrate structure shown in FIG. 21 and FIG. 22.

For example, as shown in FIG. 23 and FIG. 24, the diode functional film 143' may be divided (segmented, stripped) along the respective lines of the extension line pattern 144. FIG. 23 illustrates when this structure is applied to the embodiment shown in FIG. 18, and FIG. 24 illustrates when this structure is applied to the modification shown in FIG. 21.

Figure 25:
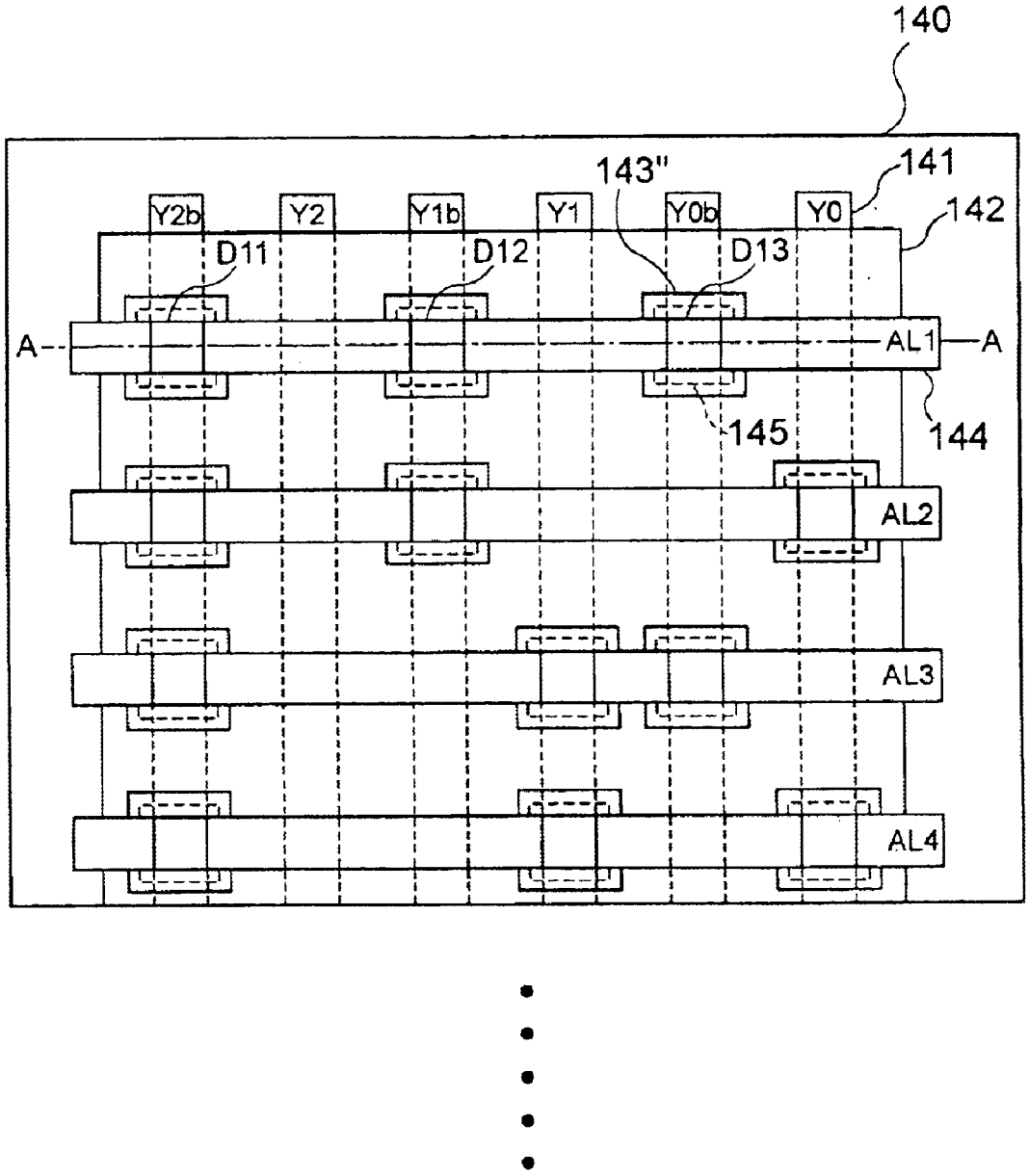
FIG. 25 shows another modified embodiment of the substrate structure shown in FIG. 18 and FIG. 19.
Figure 26:
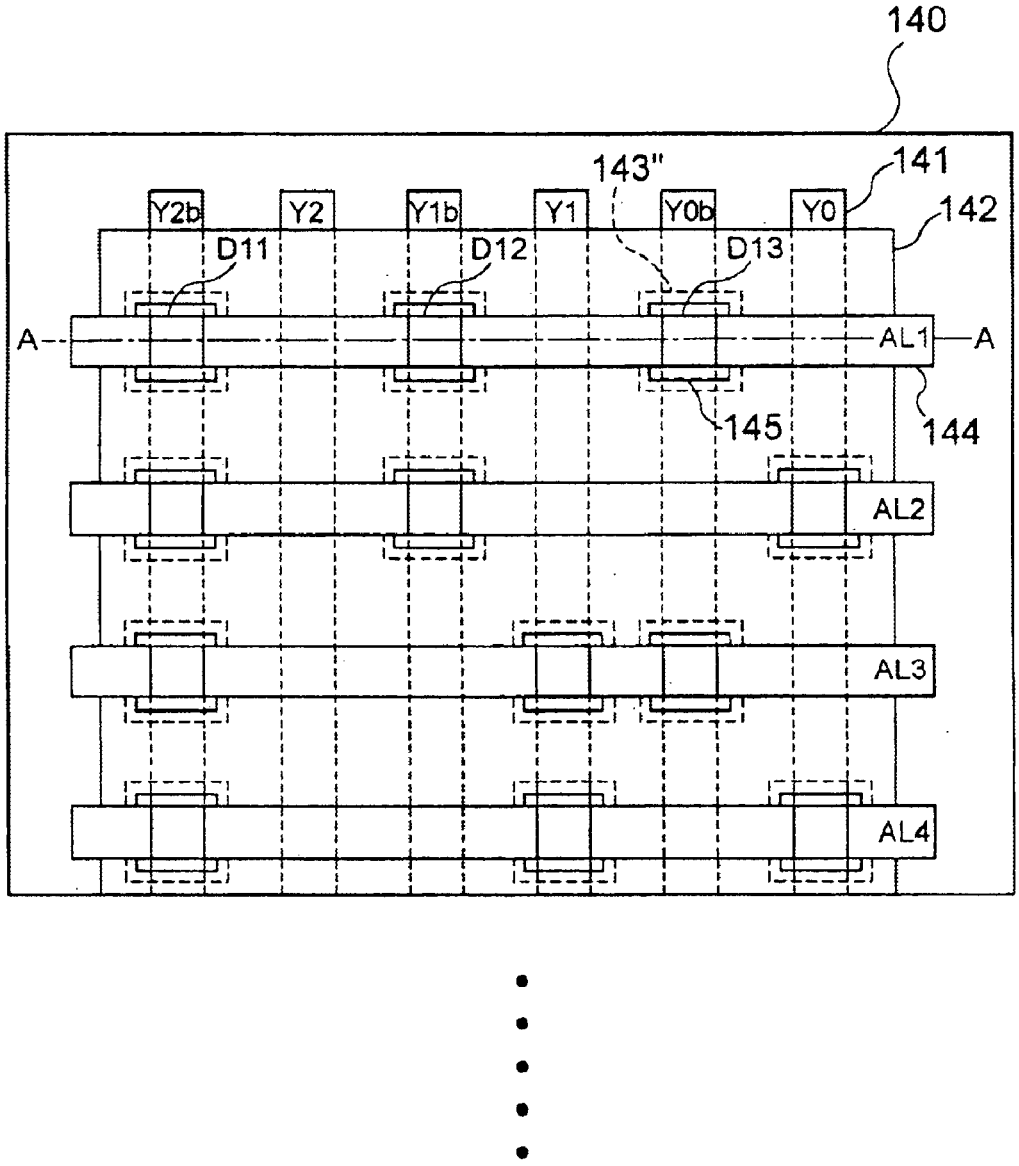
FIG. 26 shows another modified embodiment of the substrate structure shown in FIG. 21 and FIG. 22.

Alternatively, as shown in FIG. 25 and FIG. 26, the diode functional film 143" may be provided only at and/or in the vicinity of the aperture portions 145 of the insulating film 142. FIG. 25 illustrates when this structure is applied to the embodiment shown in FIG. 18, and FIG. 26 illustrates when this structure is applied to the modification shown in FIG. 21.

In addition, a substrate structure may be used which combines the substrate structure shown in FIG. 23 to FIG. 26 with a substrate structure in which the vertical positional relationship of the extension line pattern 144 and control line pattern 141 is inverted.

Figure 27:
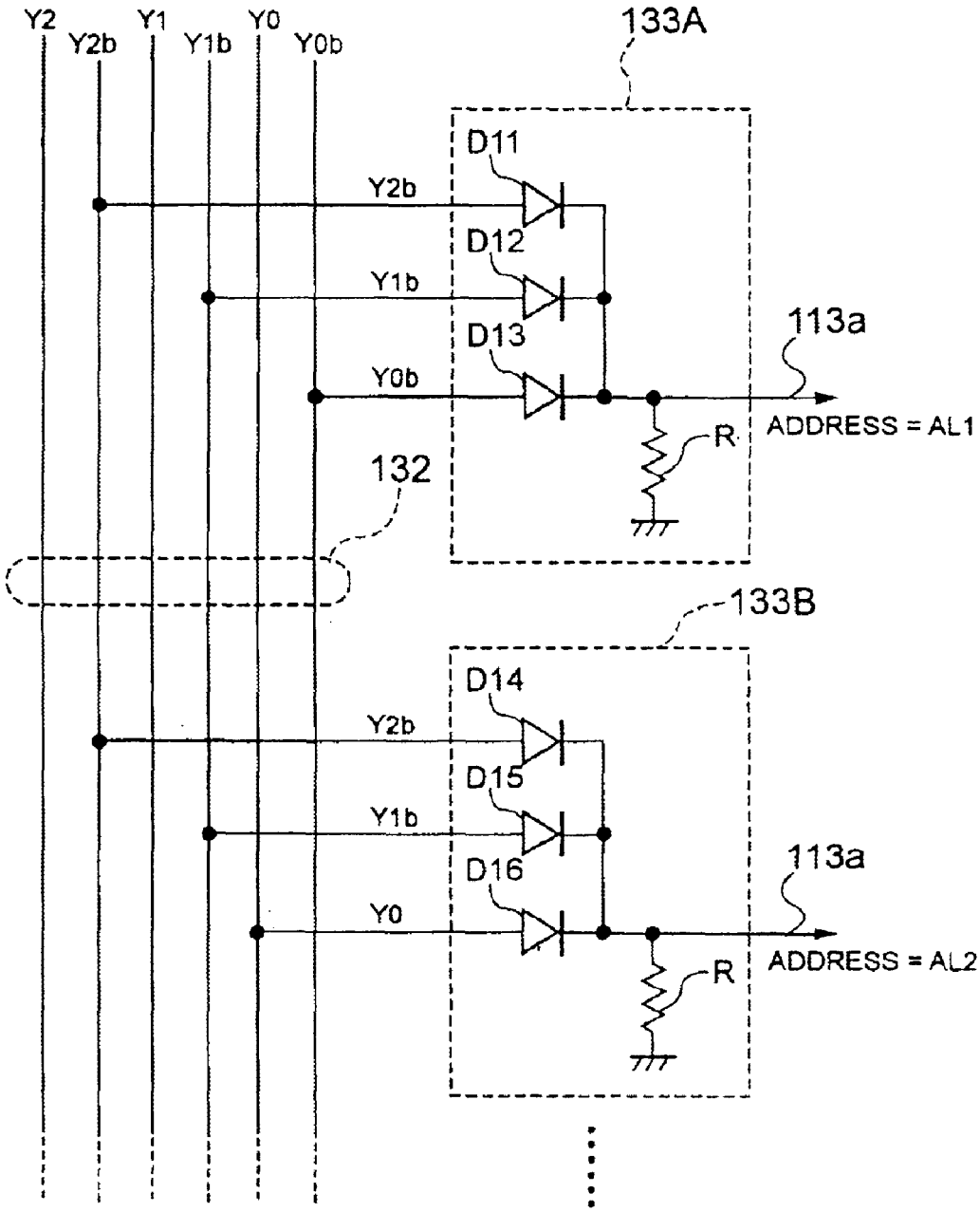
FIG. 27 is a circuit diagram showing another configuration of the address signal generation circuit of FIG. 16.

Also, by de Morgan's theorem, it is known that a logic product based on positive logic is equal to a logic sum based on negative logic. Hence, the combinatorial logic circuit shown in FIG. 16 can be configured as shown in FIG. 27, with the operation as negative-logic operation. This circuit configuration can also be provided in the various substrat structures described above. However, in this case the order of layering of the p-type semiconductor material film 143A and the n-type semiconductor material film 143B in the diode function film 143 (143', 143") is inverted compared with each of the above described examples.

Third Embodiment

Figure 28:
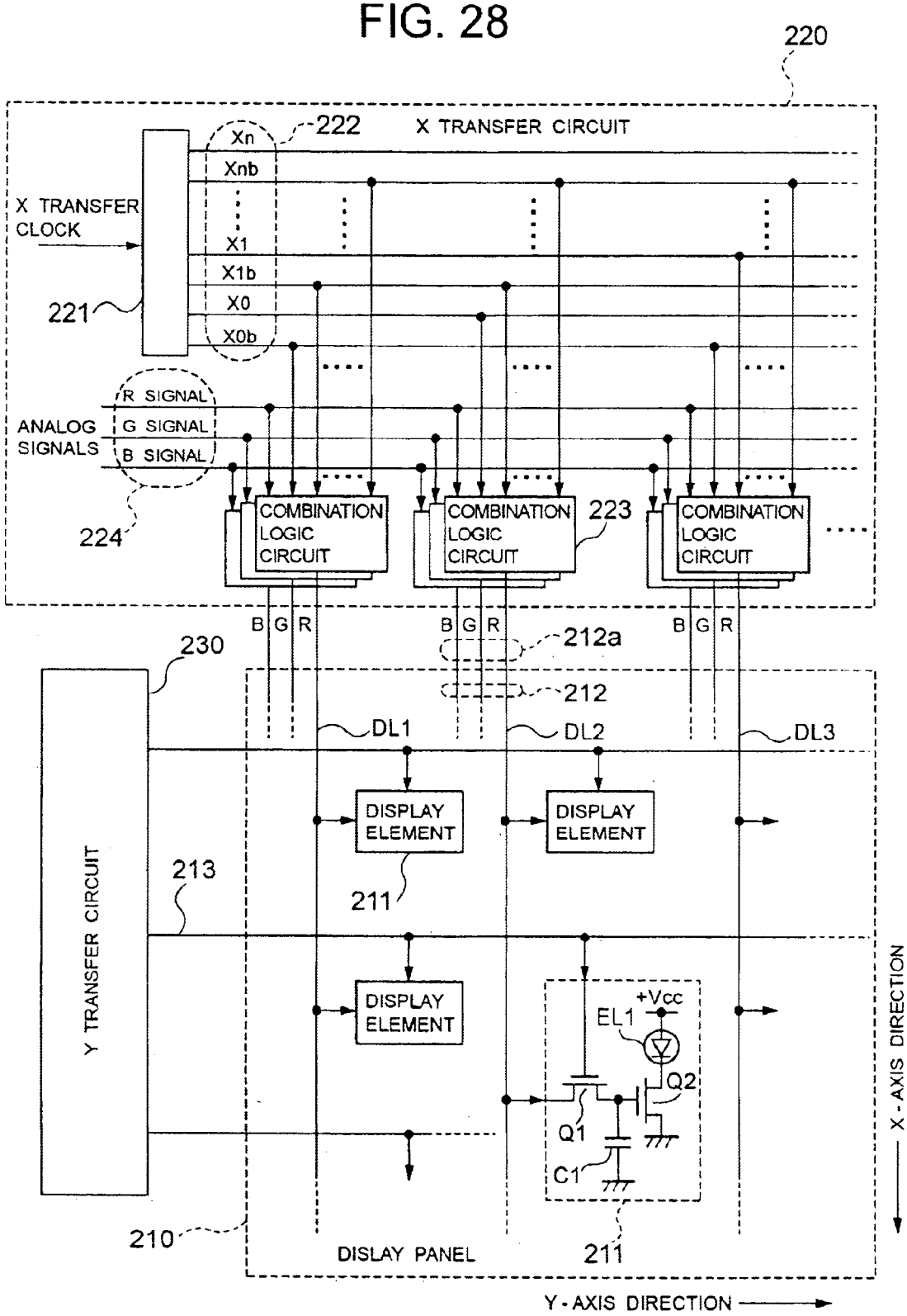
FIG. 28 is a block diagram showing the configuration of the display panel driving device of a third embodiment of the present invention.

Referring to FIG. 28, a third embodiment of a display panel driving device of the present invention will be described. Similar reference numerals are used to designate similar elements and parts in the second and third embodiments.

As shown in FIG. 28, a plurality of display elements 211 are arranged in a matrix form on the surface of the display panel 210. Each display element 211 primarily includes a light-emitting element EL1, a data-writing transistor Q1, a light-emitting element driving transistor Q2, and a storage capacitor C1. The light emission operation in the light-emitting elements 211 is described below.

First, the data-writing transistor Q1 is turned on by a Y transfer pulse (address signal) superposed on an address electrode 213 with prescribed timing. At this time, electric charge due to an X transfer pulse (data signal) superposed on the data electrode 212 is accumulated in the capacitor C1 via the data-writing transistor Q1. When the capacitor C1 has accumulated charge, this charge causes the gate potential of the driving transistor Q2 to be at a high potential, so that the transistor Q2 is turned on, and a driving current from the power supply at voltage +Vcc is supplied to the light-emitting element EL1, thereby causing the light-emitting element EL1 to emit light.

Next, a display panel driving device is described. The display panel driving device of the third embodiment is characterized by the substrate structure of the X transfer circuit 220. Hence, the following description only deals with the configuration of the X transfer circuit 220. Lines 212*a* extending to the data electrodes 212 of the display panel 210 are referred to as extension lines.

The X transfer circuit 220 is a data signal generation circuit which supplies data signals to each of the data electrode columns of the display panel 210, in sync with the X transfer clock signal (approximately 18.4 MHz) supplied by the display panel control device (not shown). The generated data signals are shown in the time chart of FIG. 29.

Figure 29:
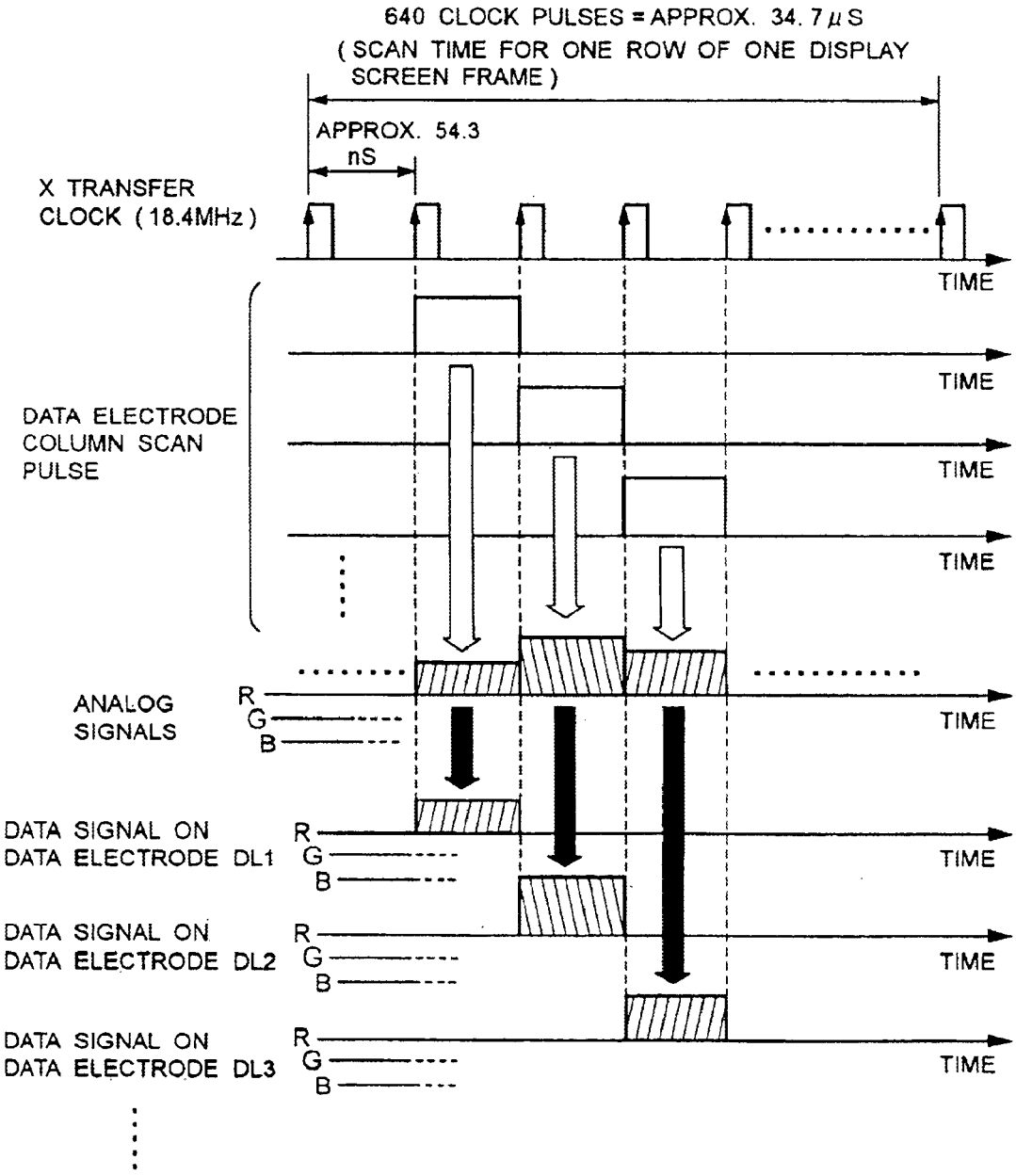
FIG. 29 is a time chart indicating the operation of the display panel driving device of FIG. 28.

As shown in FIG. 29, the X transfer circuit 220 (hereafter, for reasons of convenience the X transfer circuit 220 is called the data signal generation circuit) sequentially scans the display element groups provided across 640 columns for each RGB display element of the display panel 210 at intervals of 34.7 μs, and supplies data signals to the data electrodes. The above-mentioned time of 34.7 μs represents the time for scanning one row (1/60 Hz×480 rows) within one frame of the display screen.

As shown in FIG. 29, the data signal generation circuit 220 generates data electrode column scan pulses in sync with the X transfer clock. These data electrode column scan pulses are used to sample the analog signal for each RGB display element, so as to obtain data signals to be supplied to the data electrodes DL1 to DL640 for each RGB display element.

Next, the internal configuration of the data signal generation circuit 220 is described in greater detail. As shown in FIG. 28, the data signal generation circuit 220 includes an address line group 222 for generation of data signals (hereafter simply called the "address line group 222"), an address code supply circuit 221 which supplies address codes to the address line group 222 (hereafter simply called the "supply circuit 221"), combinatorial logic circuits 223, analog signal input line group 224, and data electrodes 212. The address codes for data signal generation are superposed on the address line group 222.

The address code is a code to decode the address of a data electrode column which is the basis for generating the data electrode column scan pulses. In other words, the supply circuit 221 counts X transfer clock pulses using, for example, a prescribed binary counter, and generates pulse signals for each digit from $2^0$ to $2^n$ as well as inverted pulse signals for each digit. The 2n-bit code resulting by juxtaposing these pulse signals is used as the address code.

In the third embodiment shown in FIG. 28, 640 columns (DL1 to DL640) of data electrodes are provided for each RGB display element in the X-axis direction in the display panel 210. Hence, the number of bits in the binary code necessary to generate the addresses of the data electrodes DL1 to DL640 is ten because of the following relation:

$$1024>640>512$$

that is, $$2^{10}>640>2^9$$

Thus, a binary code of length 10 bits is sufficient.

Hence, the supply circuit 221 can be configured using a 640-ary binary counter (not shown) which counts X transfer clock pulses and an inverter circuit (not shown). That is, in the example of FIG. 28, the address code generated by the supply circuit 221 consists of a 10-bit (n-bit; n=10) binary code and the inverted code thereof. This 20-bit (2n-bit) address code is supplied to the address line group 222. In other words, the address line group 222 includes 20 address lines on which are superposed the 10-bit binary code X9 (MSB) to X0 (LSB), and the inversion of this, X9*b* (MSB) to X0*b* (LSB).

As described above, the 640-ary binary counter counts the X transfer clock pulses (approximately 18.4 MHz), so that one counting step is the period of the X transfer clock, or approximately 54.3 ns (1/18.4 MHz), The time required for 640 counts, in which the 640-ary binary counter makes a complete cycle, is approximately 34.7 μs (approximately 54.3 ns×640 steps), equivalent to the scan time for one row in one frame of the display screen.

The combinatorial logic circuit 223 includes AND gates, OR gates, and other logic gate circuits, and is necessary for each data electrode column of each RGB display element in the display panel 210. Hence, in the embodiment shown in FIG. 28, 640 (xRGB) combinatorial logic circuits 223, corresponding to the 640 (xRGB) data electrode columns from DL1 to DL640 for each RGB display element, are required. Ten address lines (10-bit address line; n=10) from among the address line group 222 are connected to each of these combinatorial logic circuits 223. That is, each of the combinatorial logic circuits 223 uses the 10-bit code to generate scan pulses to select the data electrode 212 concerned. As shown in the time chart of FIG. 29, these scan pulses are used to sample the analog signals for each RGB display element and obtain data signals, which are supplied to the respective data electrodes 212 on the display panel 210.

Figure 30:
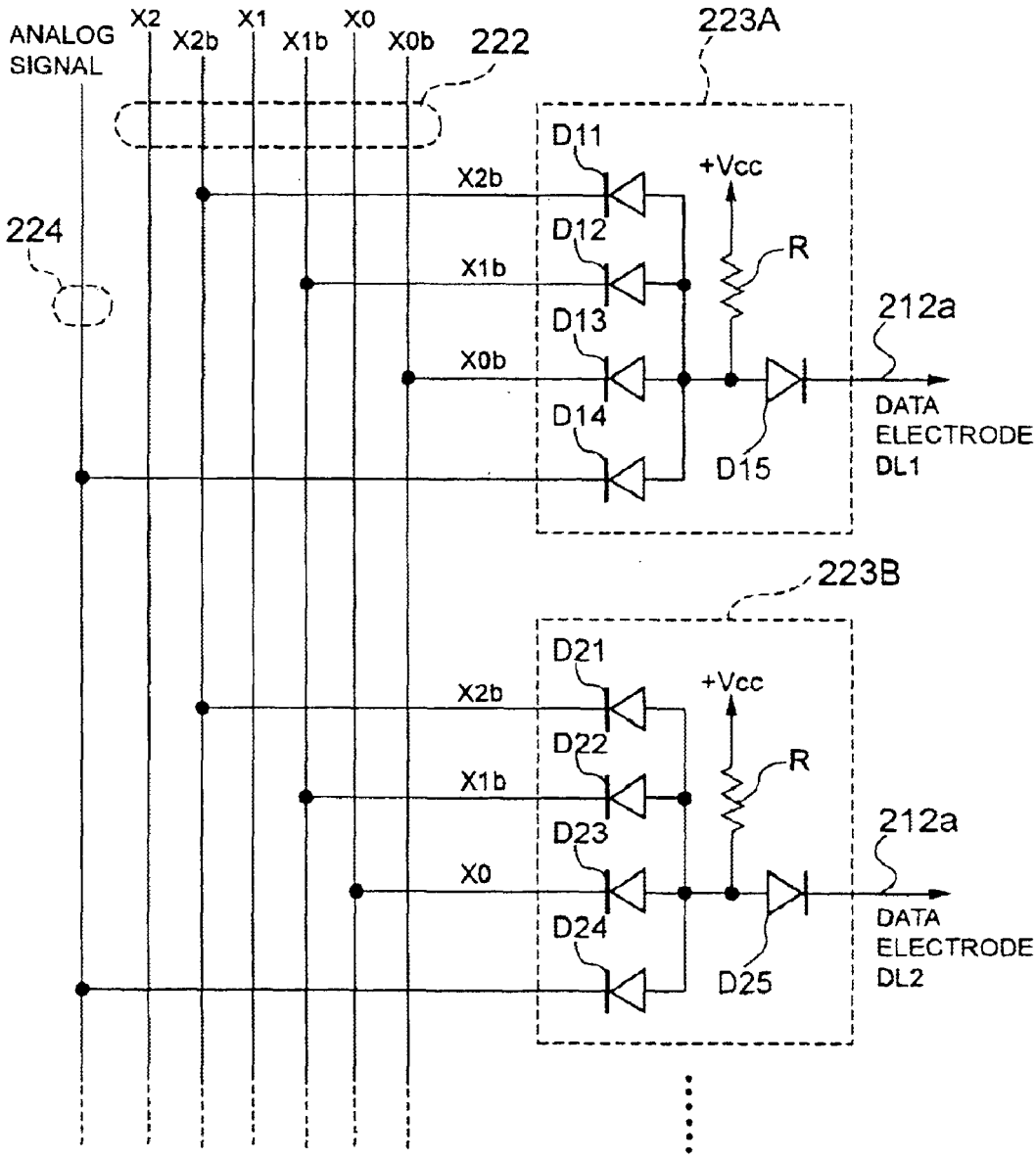
FIG. 30 is a circuit diagram of a data signal generation circuit in the display panel driving device of FIG. 28.

The specific operation and configuration of the combinatorial logic circuits 223 are described further, referring to the circuit diagram of FIG. 30.

In order to facilitate the explanation, in FIG. 30 the address line group 222 is limited to a 3-bit (n-bit; n=3) binary code. In this case, the number of addresses of the data electrode columns which can be decoded using the address code is:

$$2^n=2^3=8$$

That is, it is possible to decode eight columns, from the data electrode of the first column (DL1) represented by the 3-bit binary code "000", to the data electrode of the eighth column (DL8) represented by "111". In FIG. 30, for convenience only two combinatorial logic circuits, 223A and 223B, are shown for the two data electrode columns DL1 and DL2; but combinatorial logic circuits similar to these are provided for the data electrode columns DL3 to DL8, respectively.

A 6-bit (2n-bit) address code, which is the binary code X2 (MSB) to X0 (LSB) and the inverted code thereof X2*b* (MSB) to X0*b* (LSB), is superposed on the address line group 222 in FIG. 30. Hence, as shown in FIG. 31, when decoding the data electrode columns from DL1 to DL8, among the 6-bit address code superposed on the address line group 222, three bits will always be at logic level "1", and the remaining three bits will always be "0".

As is clear from FIG. 30, each of the combinatorial logic circuits has four diodes on the input side one diode on the output side. The cathodes of the three diodes on the input side are for input of digital signals, and are connected to the address line group 222. The cathode of the remaining one of the input-side diodes is used for analog signal input and is connected to a prescribed line among the analog signal input line group 224. The analog signal input line group 224 is provided corresponding to the RGB display elements, and a voltage representing the amplitude value of the analog signal is superposed for each of the RGB elements. In FIG. 30, for convenience in explanation only one line among the analog signal input line group 224 is shown. In the circuit of FIG. 30 the cathode of the output-side diode is used for the analog signal output, and is connected to the associated data electrode 212. The anodes of the diodes are all connected in parallel, and the connection point of the anodes, that is, the common anode, is connected to the power supply voltage Vcc via a pull-up resistance R.

In the circuit of FIG. 30, if the threshold voltage for logic level "1" is VH, the threshold voltage for logic level "0" is VL in the address code superposed on the address line group 222, and the analog signal input line voltage is Van, then it is assumed that the following relation is established:

$$VH>Van>VL$$

Further, the following relation naturally holds true between the power supply voltage Vcc of the combinatorial logic circuit and the analog signal input line voltage Van:

$$Vcc>Van$$

At the instant at which the digital inputs to the three diodes of the combinatorial logic circuit from the address line group 222 are all logic level "1", the three diodes are all turned off. On the other hand, because the cathode-side voltage Van is lower than the anode-side voltage Vcc, the analog input diode maintains the on state.

Hence, at the above-mentioned instant, the potential of the common anode of the combinatorial logic circuit becomes the voltage Van of the analog signal input line at that time. And this voltage Van is supplied to the associated data electrode 212 via the analog output diode.

In the circuit shown in FIG. 30, the combinatorial logic circuit 223A is the decoding circuit for the first column, that is, the data electrode DL1, and the combinatorial logic circuit 223B is the decoding circuit for the second column, that is, the data electrode DL2. The cathodes of the diodes D11 to D13 of the combinatorial logic circuit 223A are connected to the three address lines X2*b*, X1*b*, X0*b* from among the address line group 222. Similarly, the cathodes of the diodes D21 to D23 of the combinatorial logic circuit 223B are connected to the three address lines X2*b*, X1*b*, X0 from among the address line group 222.

As is clear from the relationship between data electrode addresses and address codes shown in FIG. 31, when decoding the data electrode DL1 address, the logic levels of the three bits X2*b*, X1*b*, X0*b* are all "1", and when decoding the data electrode DL2 address, the logic levels of the three bits X2*b*, X1*b*, X0 are "1". Hence, when an address code indicates one address, the voltage Van of the analog signal input line is output as the data signal to the corresponding data electrode from the combinatorial logic circuit designated by the address code.

In this embodiment, therefore, the data signal generation circuit in the display panel driving device can be provided using only simple combinatorial logic circuits employing diodes only, without using shift register circuits or sample-hold circuits. Consequently, amorphous silicon, organic semiconductors and other semiconductor materials which are low in cost and facilitate manufacture can be used as constituent members of the display panel driving device.

Figure 32:
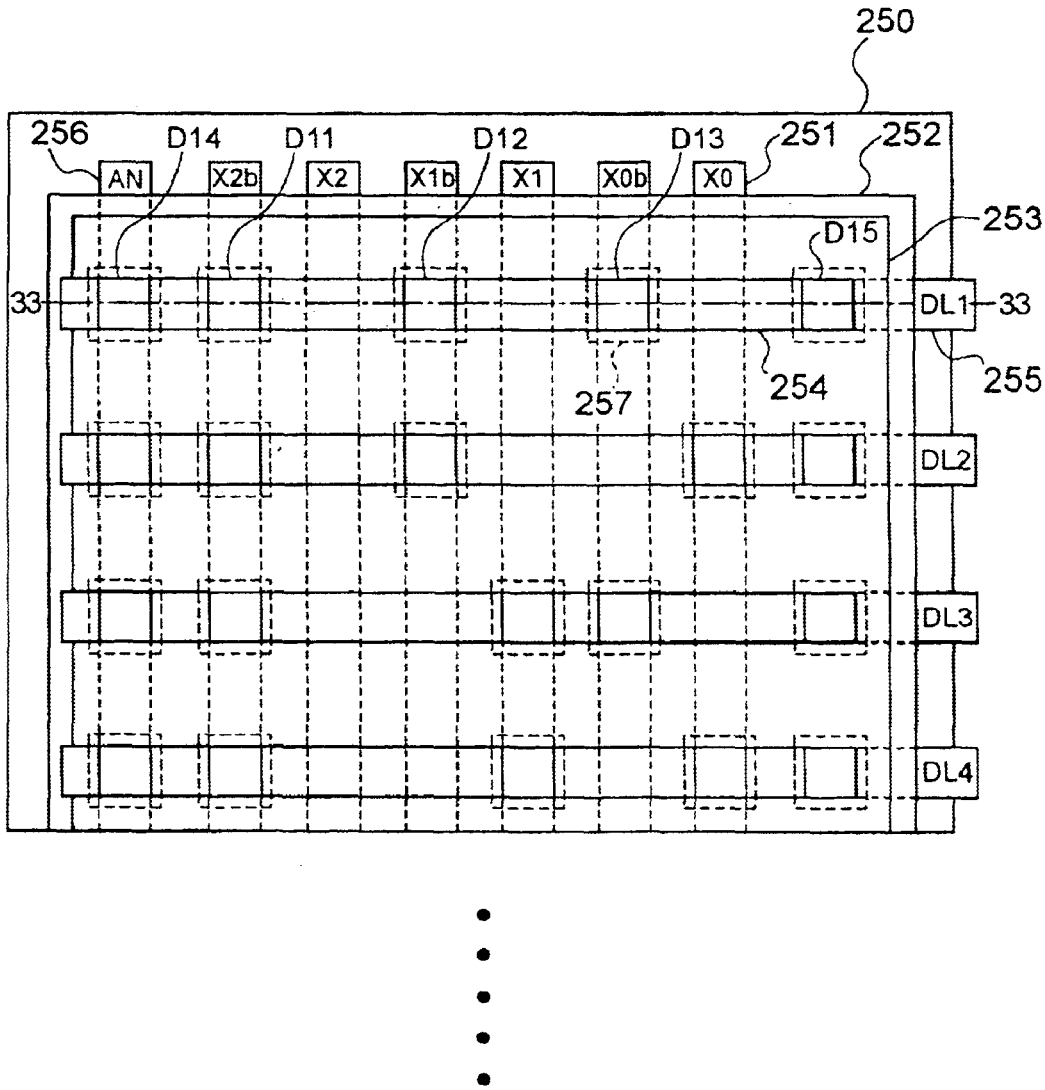
FIG. 32 illustrates a substrate structure of a first example when mounting the circuit of FIG. 30 on a substrate.
Figure 33:
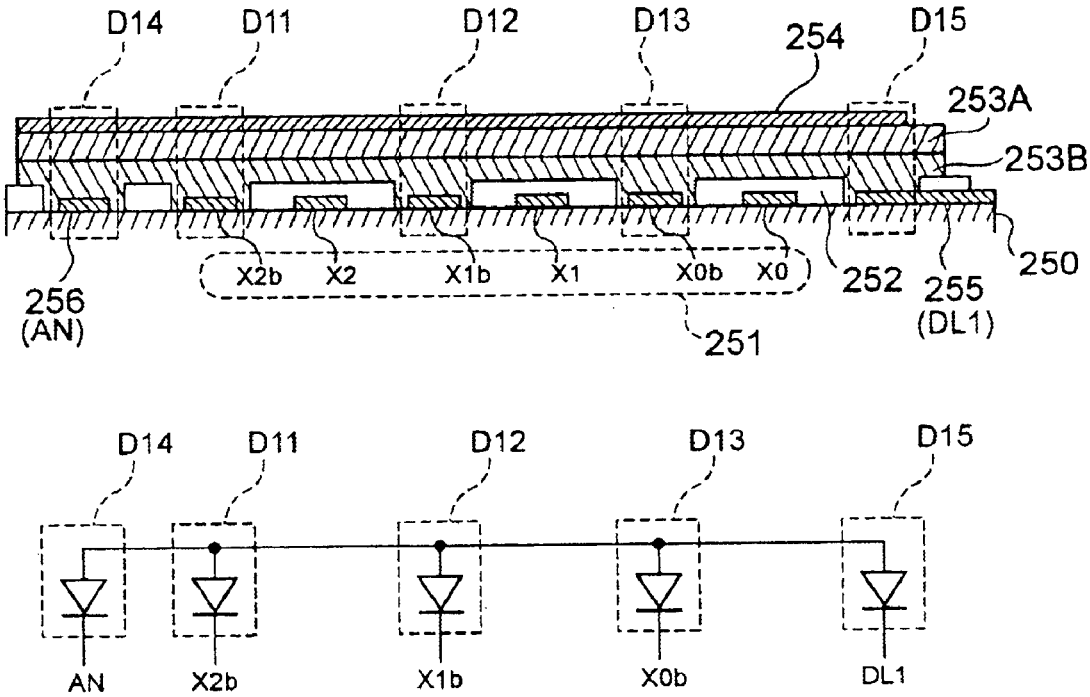
FIG. 33 is a cross-sectional view along the line 33—33 in FIG. 32.

The substrate structure of the combinatorial logic circuit of FIG. 30 is shown in FIG. 32, and a cross-sectional view along the line 33—33 in FIG. 32 is shown in FIG. 33.

In FIG. 32 and FIG. 33, the substrate 250 is the substrate on which is formed the circuit shown in FIG. 30. A combinatorial logic circuit formed with the substrate structure shown in FIG. 32 and FIG. 33 is equivalent to the circuit shown in FIG. 30, but for convenience in explanation the power supply voltage Vcc and pull-up resistance R are omitted from the drawing. Also, it should be noted that there is no need for the substrate structure shown in FIG. 32 to be separate from other parts of the driving device of the display panel 210; for example, the substrate structure may be mounted together with the TFT circuits for display elements on a transparent substrate of glass or a polymer material which forms the display panel 210.

In the structural diagram of FIG. 32, the address line pattern for data signal generation 251 (below, simply called the "address line pattern 251") is the physical implementation of each of the address lines forming the address line group 222. The address line pattern 251 is a wiring pattern, formed on the substrate 250 by for example evaporation deposition or printing of a copper alloy, aluminum alloy or other conductive material. When providing the substrate structure of FIG. 32 on the display panel 210 together with TFT circuits for display elements, the address line pattern 251 may be transparent electrodes employing ITO (indium tin oxide) or another suitable conductive material.

The data electrode extension line pattern 255 (hereafter simply called the "extension line pattern 255") is implemented on the substrate 250 by extension lines 212*a* of data electrodes 212 in the circuit diagram of FIG. 30. The lines of the extension line pattern 255 are extended and connected to the data electrodes 212 of the display panel 210. The analog signal input line pattern 256 (hereafter simply called the "analog line pattern 256") is implemented on the substrate 250 by any of the RGB analog signal input lines of the analog signal input line group 224. The materials and method of manufacture of the extension line pattern 255 and analog line pattern 256 are similar to those of the address line pattern 251.

The insulating film 252 is a thin film of, for example, silicon oxide or silicon nitride, having good insulating properties, and is provided in contact with the surface of the substrate 250 and covering the address line pattern 251, extension line pattern 255, and analog line pattern 256.

The diode functional film 253 is a thin film having so-called diode functions exhibiting unidirectional conductivity. The diode functional film 253 is provided in contact with the insulating film 252, and includes a layering of a p-type semiconductor material layer 253A and an n-type semiconductor material layer 253B, as shown in FIG. 33, That is, by means of a PN junction defined by the p-type semiconductor material film 253A and the n-type semiconductor material film 253B, a diode is formed in the diode functional film 253, with the 253A side as an anode and the 253B side as a cathode. The material of the p-type semiconductor material film 253A and n-type semiconductor material film 253B is, for example, amorphous silicon material, or organic semiconductor material.

The method for formation of the insulating film 252 and diode functional film 253 on the substrate 250 may be evaporation deposition, printing, vapor phase growth, or other suitable thin film fabrication methods. The thin film fabrication methods best suited to the materials used in the insulating film 252 and diode functional film 253 may be used.

The control connection line pattern 254 (hereafter simply called the "connection line pattern 254") is implemented on the substrate 250 by the connection portion on the common anode side of each of the diodes of the combinatorial logic circuit of FIG. 30. Similar to the address line pattern 251, the connection line pattern 254 is formed on top of the diode functional film 253 from aluminum alloy or another conductive material. The connection line pattern 254 encloses the insulating film 252 and diode functional film 253, and is provided on the opposite side of the address line pattern 251, extension line pattern 255, and analog line pattern 256.

As shown in FIG. 32, one line of the connection line pattern 254 is provided for each combinatorial logic circuit, and the lines of the connection line pattern 254 perpendicularly intersect the lines of the address line pattern 251 and the lines of the analog line pattern 256. The end portions of the connection line pattern 254 are provided so as to overlap the end portions of the extension line pattern 255.

As is clear from FIG. 32 and FIG. 33, aperture portions 257 are provided in the insulating film 252 at some of the intersections of the connection line pattern 254 and address line pattern 251. In addition, aperture portions 257 are provided in the insulating film 252 at all locations at which the connection line pattern 254 and analog line pattern 256 intersect, and at which the end portions of the connection line pattern 254 overlap the end portions of the extension line pattern 255. The insulating film 252 is removed at these aperture portions 257, so that electrical contact is established between the upper and lower patterns sandwiching the diode functional film 253. That is, at the aperture portions 257, PN junction diodes comprising the P-type semiconductor material film 253A and N-type semiconductor material film 253B are connected between the connection line pattern 254, and the address line pattern 251, analog line pattern 256 and extension line pattern 255.

This situation is described as follows, using the cross-sectional diagram of FIG. 33. From the left side in FIG. 33, first the diode D14 is formed between the connection line pattern 254 and the analog line pattern 256. Then, the diodes D11, D12, and D13 are formed between the connection line pattern 254 and the address line pattern 251. On the right-hand edge in FIG. 33, the diode D15 is formed between the connection line pattern 254 and the extension line pattern 255.

The connection line pattern 254 is connected to the anodes of the diodes, and the respective other patterns are connected to the cathodes. The connection line pattern 254 is a single wiring pattern, so that the anodes of the diodes formed at the aperture portions 257 are connected together by the connection line pattern 254. That is, the anodes of the diodes formed along each line of the connection line pattern 254 are all connected in parallel, as shown in FIG. 33.

For example, in FIG. 32 the line of the connection line pattern 254 for the data electrode DL1 forms a diode array in which are connected in parallel the anodes of the diodes D14, D11, D12, D13, and D15. The cathodes of the diodes are connected to the analog line pattern 256, the lines X2*b*, X1*b* and X0*b* of the address line pattern 251, and the data electrode extension line pattern 255 (DL1), respectively. Hence, the electrical circuit formed along the line of the connection line pattern 254 is equivalent to the combinatorial logic circuit 223A shown in FIG. 30.

In this embodiment, therefore, the diode circuits formed on the substrate 250 utilizing the aperture portions 257 in the insulating film 252 can be employed as the combinatorial logic circuits shown in FIG. 30. Consequently, apart from the analog line pattern 256, address line pattern 251 and other signal patterns on the substrate 250, there is no need to provide combinatorial logic circuits or through-holes connecting these combinatorial logic circuits to the respective patterns. Thus, the substrate structure of the display driving device can be simplified and made more compact.

Figure 34:
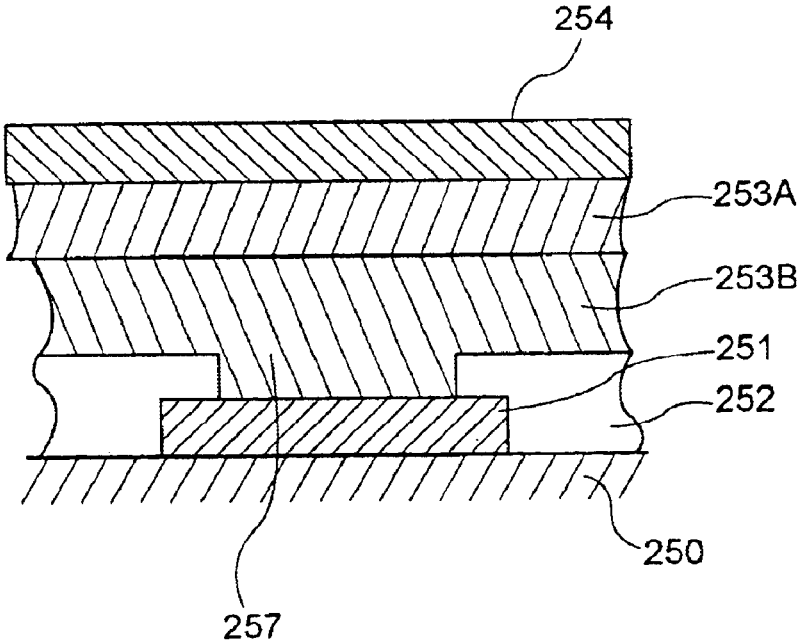
FIG. 34 is a substrate structure cross-sectional diagram showing a modified embodiment of the structure shown in FIG. 32 and FIG. 33.

This embodiment is not limited to the substrate structure shown in FIG. 32 and FIG. 33; for example, as shown in FIG. 34, the end (edge) portions of the address line pattern 251 are covered by the insulating film 252. Other modifications will be described below.

A second modification of the display panel driving device of the third embodiment is described with reference to FIG. 35 and FIG. 36.

Figure 35:
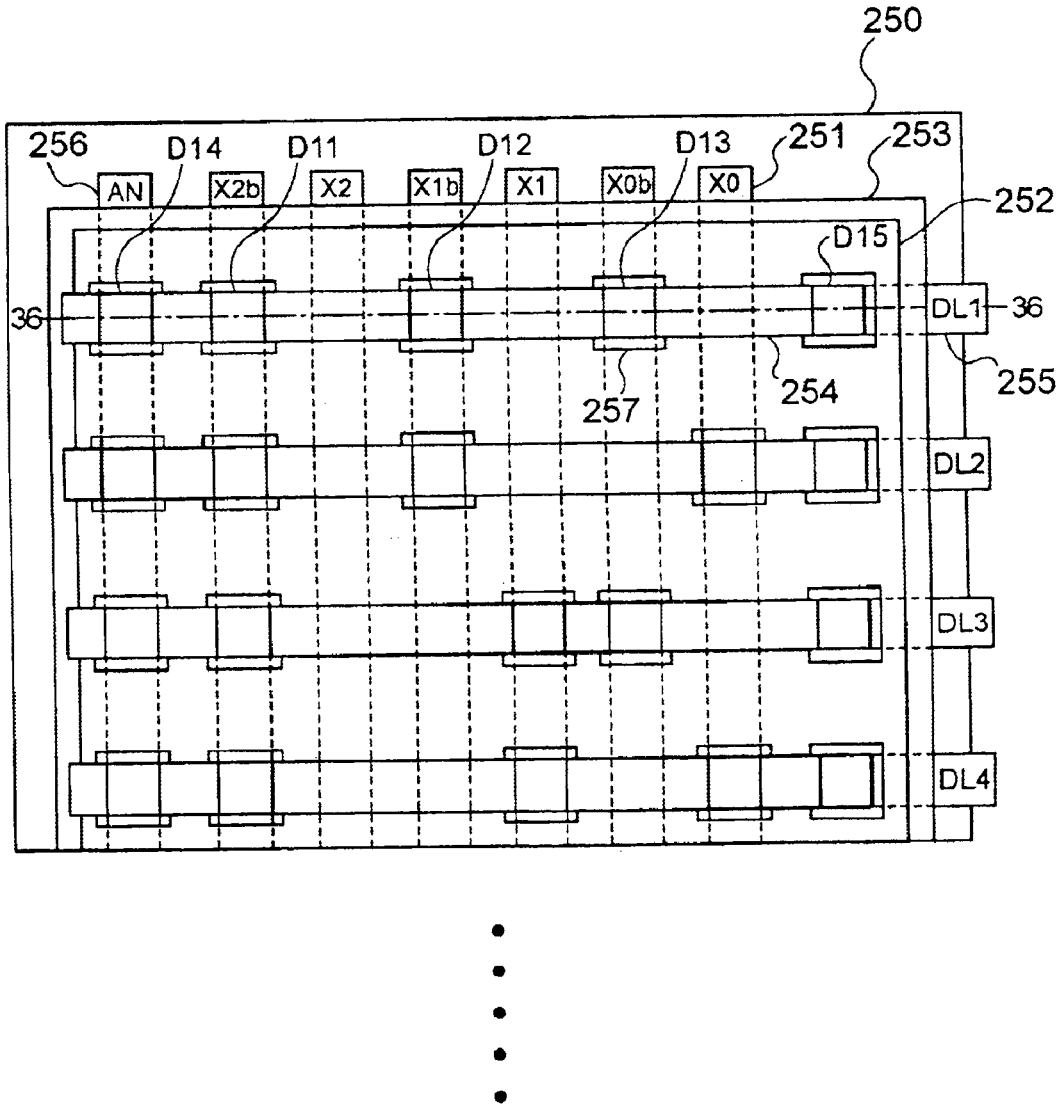
FIG. 35 is a substrate structure diagram showing a second example when mounting the circuit of FIG. 30 on the substrate.
Figure 36:
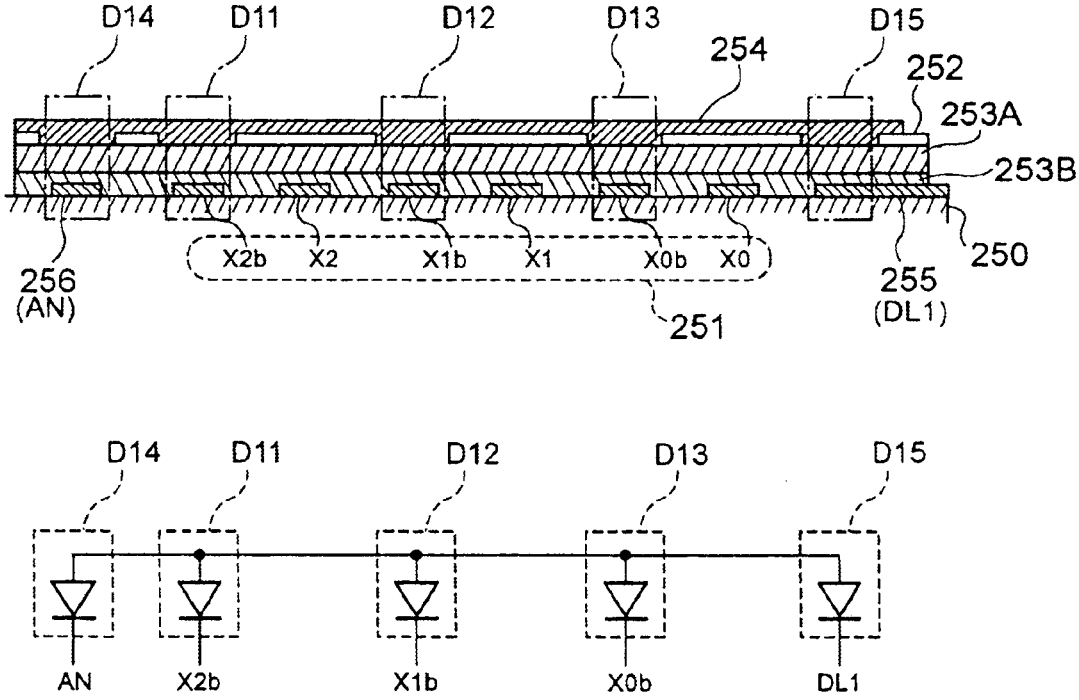
FIG. 36 is a cross-sectional view along the line 36—36 in FIG. 35.

FIG. 35 illustrates the substrate structure of the display panel driving device of the second modification, and FIG. 36 illustrates a cross-sectional view along the line 36—36 in FIG. 35.

As shown in FIG. 36, in the substrate structure of this modification the provision of the address line pattern 251, analog line pattern 256, and extension line pattern 255 on the substrate 250 is similar to that of the third embodiment (FIG. 32 and FIG. 33). However, in this modification these patterns are covered in a different way; first an N-type semiconductor material film 253B is provided, and on top of this thin films of a P-type semiconductor material film 253A and an insulating film 252 are deposited in order. The connection line pattern 254 is then provided on top of the insulating film 252, and aperture portions 257 are provided in the insulating film 252 at prescribed positions of the intersections where these patterns intersect or overlap. Hence, PN junction diodes of the diode functional film 253 are connected between the upper and lower patterns which intersect or overlap above and below these aperture portions 257.

That is, in the second modification, the layering order of the insulating film 252 and the diode functional film 253 in the third embodiment is interchanged. This is the only structural difference between this modification and the third embodiment, and so explanations of the structure and operation of the second modification are omitted.

The display panel driving device of the third embodiment is not limited to the above described examples (FIG. 32 to FIG. 36).

For instance, in the substrate structure shown in the third embodiment and second modification, the vertical positional relationship of the connection line pattern 254. address line pattern 251, analog line pattern 256, and extension line pattern 255 may be inverted. Specifically, the connection line pattern 254 may be provided on the substrate 250, and on top of this may be formed the address line pattern 251, analog line pattern 256 and extension line pattern 255, enclosing the insulating film 252 and diode functional film 253.

Further, in the above explanations the diode functional film 253 extends over the entire upper or lower surface of the insulating film 252; but the area over which the diode functional film 253 is provided may be limited to a prescribed range.

Figure 37:
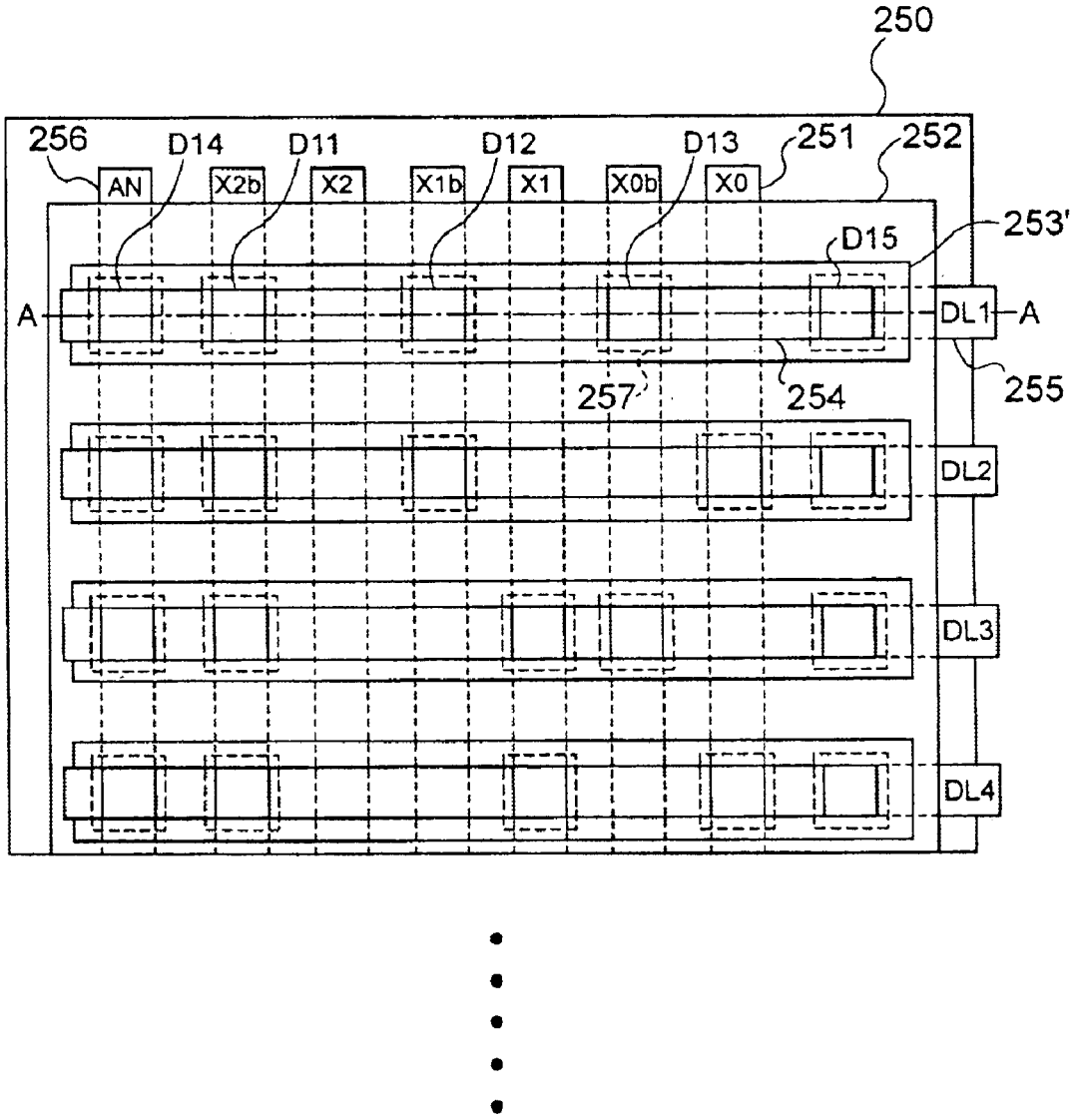
FIG. 37 shows a modified embodiment of the substrate structure shown in FIG. 32 and FIG. 33.
Figure 38:
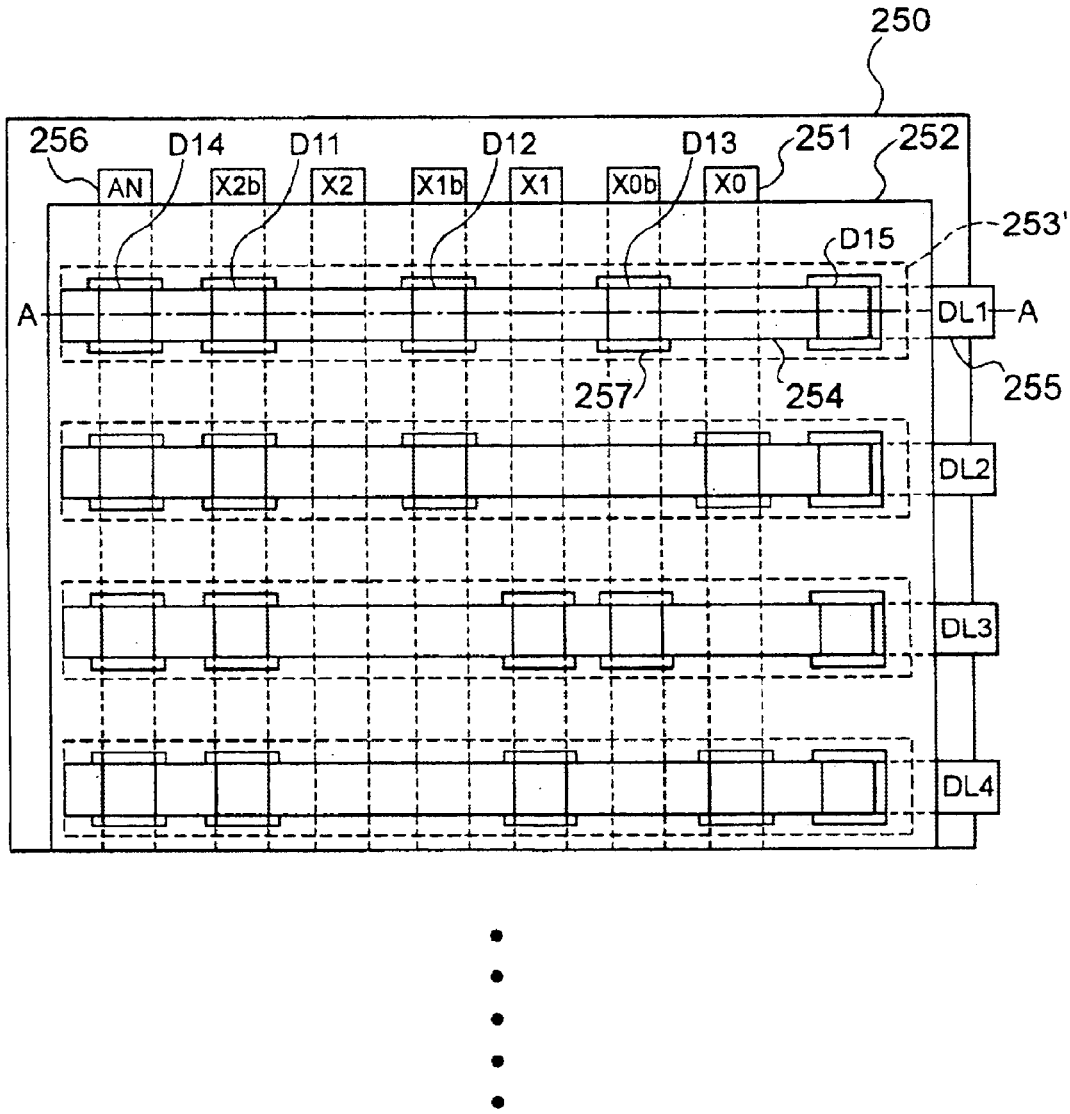
FIG. 38 shows a modified embodiment of the substrate structure shown in FIG. 35 and FIG. 36.

For example, as shown in FIG. 37 and FIG. 38, the diode functional film 253' may be segmented to extend along each line of the connection line pattern 254. FIG. 37 shows this structure applied to the third embodiment shown in FIG. 32; FIG. 38 shows a case of application to the second modification shown in FIG. 35.

Figure 39:
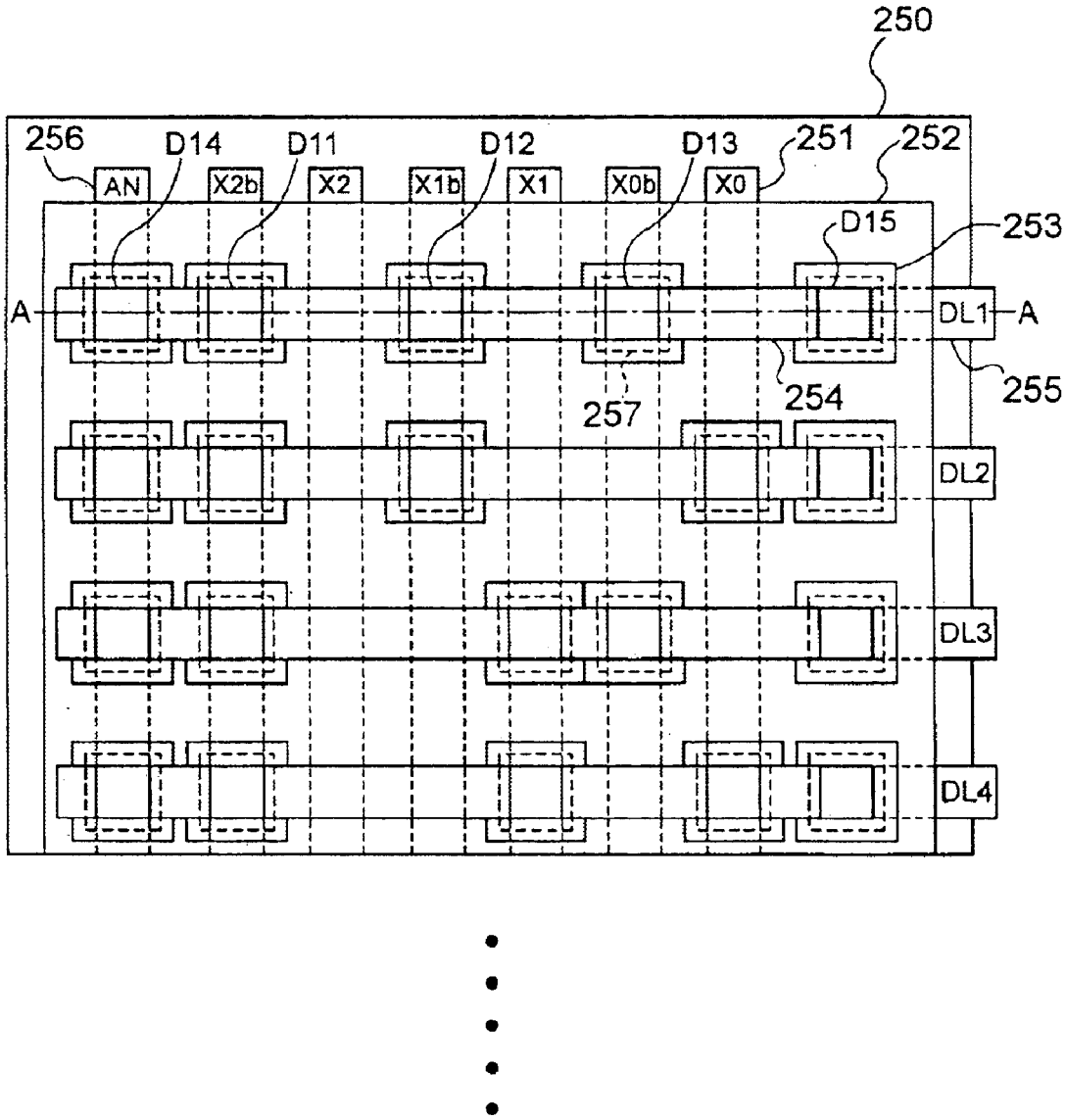
FIG. 39 shows another modified embodiment of the substrate structure shown in FIG. 32 and FIG. 33.
Figure 40:
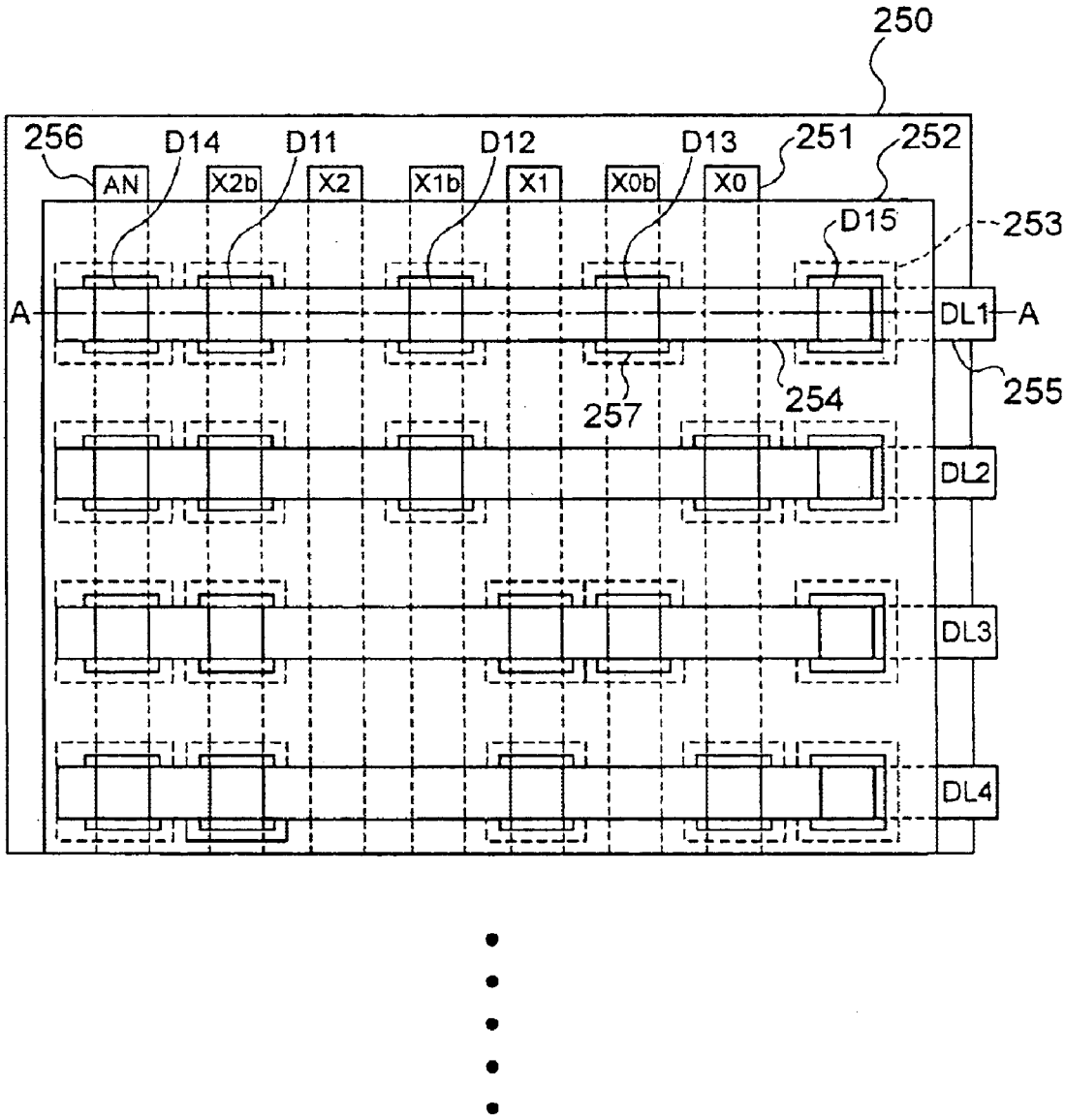
FIG. 40 shows another modified embodiment of the substrate structure shown in FIG. 35 and FIG. 36; and, FIG. 41 is a circuit diagram showing another configuration of the data signal generation circuit of FIG. 30.

Alternatively, as shown in FIG. 39 and FIG. 40, the diode functional film 253" may be provided only at and in the vicinity of the aperture portions 257 in the insulating film 252. FIG. 39 shows this structure applied to the third embodiment shown in FIG. 32; FIG. 40 shows a case of application to the second modification of FIG. 35.

Further, the substrate structure shown in FIG. 37 to FIG. 40 may be combined with a substrate structure in which the vertical positional relationships of the connection line pattern 254, address line pattern 251, analog line pattern 256, and extension line pattern 255 are inverted.

Figure 41:
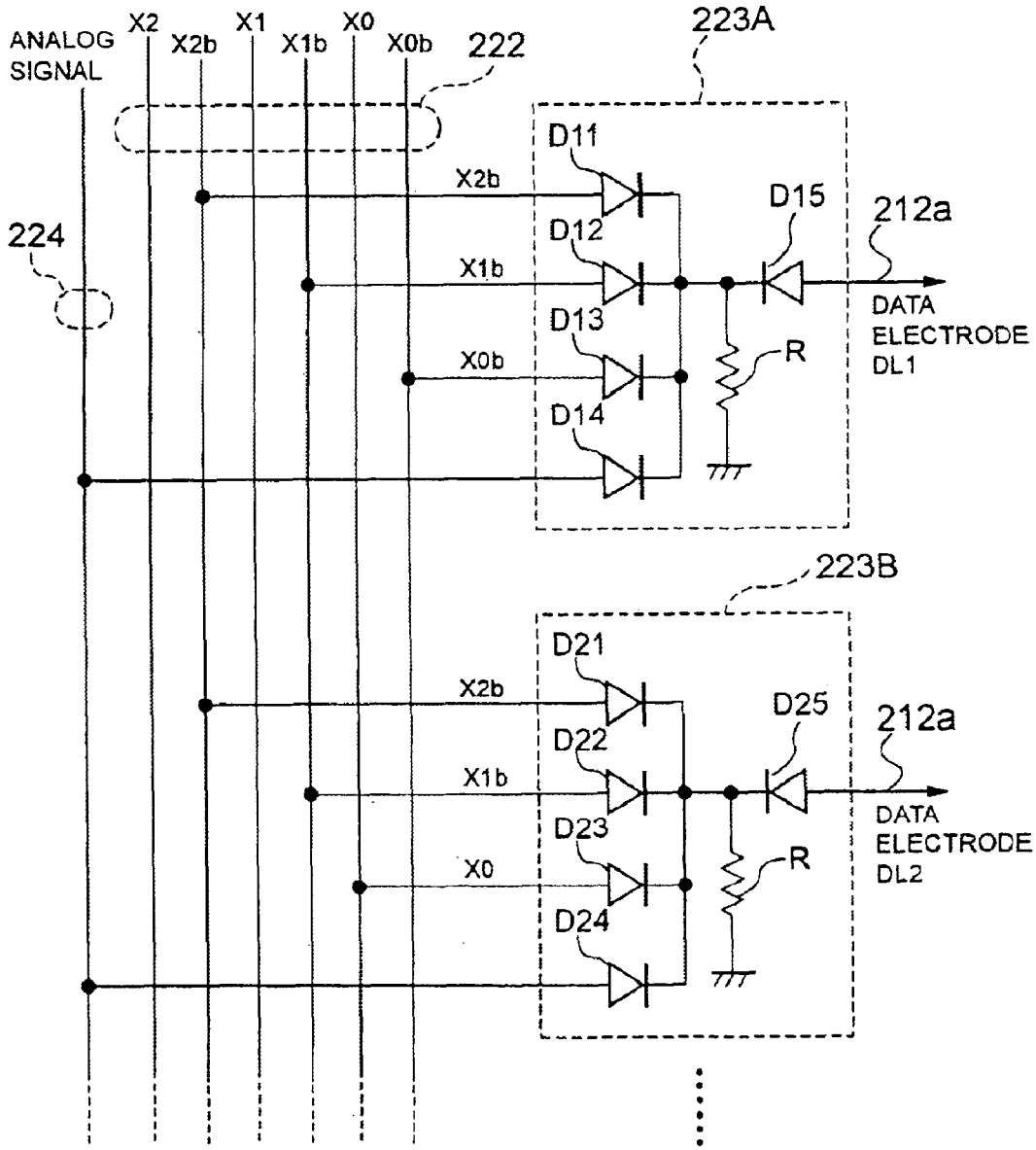

By de Morgan's theorem, it is known that a logic product based on positive logic is equal to a logic sum based on negative logic. Hence, the combinatorial logic circuit shown in FIG. 30 can be configured as shown in FIG. 41, with the operation as negative-logic operation. This circuit configuration can also be provided on the various substrate structures described above. In this case, the order of layering of the p-type semiconductor material film 253A and the n-type semiconductor material film 253B of the diode function film 253 is inverted compared with the above described examples.

This application is based on Japanese Patent Application Nos. 2002-294839 and 2002-294840, and the entire disclosures of these two Japanese Patent Applications are incorporated herein by reference.

What is claimed is:

1. A driving device for a display panel, the display panel including a plurality of address electrodes, a plurality of data electrodes, a plurality of display elements and a first substrate such that the plurality of address electrodes and data electrodes intersect each other on the first substrate and enclose the plurality of display elements between the plurality of address electrodes and data electrodes, the driving device comprising:

a second substrate;

a plurality of control lines for address signal generation, provided mutually in parallel;

an insulating film;

a channel material film in contact with the insulating film; and, a plurality of extension lines extending to the plurality of address electrodes, respectively, such that at least the insulating film is enclosed between the plurality of extension lines and the plurality of control lines on the second substrate, and such that the plurality of extension lines intersect with the plurality of control lines to form a plurality of intersecting portions, and each of the plurality of extension lines has at least one disconnected portion at the plurality of intersecting portions.

2. The driving device according to claim 1, wherein each of the control lines is in contact with the second substrate.

3. The driving device according to claim 1, wherein each of the extension lines is in contact with the second substrate.

4. The driving device according to claim 1, wherein the control lines and the extension lines enclose the insulating film only, and the channel material film extends in the disconnected portions of the extension lines and further extends over the extension lines.

5. The driving device according to claim 1, wherein the channel material film is segmented into a plurality of film segments such that the plurality of film segments extend along the plurality of extension lines, respectively.

6. The driving device according to claim 1, wherein the channel material film is provided only in the disconnected portions of the extension lines.

7. The driving device according to claim 1, wherein the insulating film and the channel material film are both enclosed between the plurality of extension lines and the plurality of control lines on the second substrate.

8. The driving device according to claim 1, wherein the first substrate and the second substrate are the same substrate.

9. A driving device for a display panel, the display panel including a plurality of address electrodes, a plurality of data electrodes, a plurality of display elements and a first substrate such that the plurality of address electrodes and data electrodes intersect each other on the first substrate and enclose the plurality of display elements between the plurality of address electrodes and data electrodes, the driving device, comprising:

a second substrate;

a plurality of control lines for address signal generation, provided mutually in parallel;

an insulating film;

a diode functional film; and, a plurality of extension lines extending to the plurality of address electrodes, respectively, such that the insulating film and the diode functional film generally extend between the plurality of extension lines and the plurality of control lines on the second substrate, such that the plurality of extension lines intersect with the plurality of control lines to form a plurality of intersecting portions, and such that the insulating film has at least one aperture in at least one of the plurality of intersecting portions.

10. The driving device according to claim 9, wherein each of the control lines is in contact with the second substrate.

11. The driving device according to claim 9, wherein each of the extension lines is in contact with the second substrate.

12. The driving device according to claim 9, wherein the insulation film is in contact with the second substrate.

13. The driving device according to claim 9, wherein the diode functional film is in contact with the second substrate.

14. The driving device according to claim 9, wherein the diode functional film is segmented into a plurality of film segments such that the plurality of film segments extend along the plurality of extension lines, respectively.

15. The driving device according to claim 9, wherein the diode functional film is provided only in the at least one aperture of the insulating film.

16. The driving device according to claim 9, wherein the diode functional film includes a stacked film having a p-type semiconductor material film and an n-type semiconductor material film.

17. The driving device according to claim 9, wherein the first substrate and the second substrate are the same substrate.

18. A driving device for a display panel, the display panel including a plurality of address electrodes, a plurality of data electrodes, a plurality of display elements and a first substrate such that the plurality of address electrodes and data electrodes intersect each other on the first substrate and enclose the plurality of display elements between the plurality of address electrodes and data electrodes, the driving device comprising:

a second substrate;

a plurality of control lines for data signal generation;

at least one analog signal input line, extending in parallel with the plurality of control lines;

a plurality of control connection lines, intersecting the plurality of control lines and the at least one analog signal input line to form a plurality of intersecting portions, such that the insulating film and diode functional film generally extend between the plurality of control connection lines and the plurality of control lines and at least one analog signal input line on the second substrate; and, a plurality of extension lines extending to the plurality of data electrodes, respectively, such that the plurality of extension lines have overlapping portions which overlap end portions of the control connection lines on the second substrate to sandwich the insulating film and the diode functional film, and wherein the insulating film has aperture portions in at least one of the plurality of intersecting portions and in the overlapping portions.

19. The driving device according to claim 18, wherein the control lines, the at least one analog signal input, and the extension lines are each in contact with the second substrate.

20. The driving device according to claim 18, wherein each of the control connection lines is in contact with the second substrate.

21. The driving device according to claim 18, wherein the insulation film is in contact with the second substrate.

22. The driving device according to claim 18, wherein the diode functional film is in contact with the second substrate.

23. The display panel driving device according to claim 18, wherein the diode functional film is segmented into a plurality of film segments such that the plurality of film segments extend along the plurality of extension lines, respectively.

24. The driving device according to claim 18, wherein the diode functional film is provided only in the aperture portions of the insulating film.

25. The driving device according to claim 18, wherein the diode functional film includes a stacked film having a p-type semiconductor material film and an n-type semiconductor material film.

26. The driving device according to claim 18, wherein the first substrate and the second substrate are the same substrate.

* * * * *